US005333874A

United States Patent [19]

Arnold et al.

[11] Patent Number: 5,333,874

[45] Date of Patent: Aug. 2, 1994

[54] SPORTS SIMULATOR

[75] Inventors: Floyd L. Arnold, 3925 Tierra Vista Pl., Escodido, Calif. 92064; Carl J. Bair, 5565 Diane Ave., San Diego, Calif. 92117; Christopher M. Kiraly, San Diego, Calif.; William P. Norgren, San Diego, Calif.; George V. Wintriss, Encintas, Calif.

[73] Assignees: Floyd L. Arnold, Escondido; Carl J. Bair, Poway, both of Calif.

[21] Appl. No.: 881,393

[22] Filed: May 6, 1992

[51] Int. Cl.[5] ..... A63B 69/36

[52] U.S. Cl. ..... 273/185 B; 273/181 H; 273/183.1; 273/185 R; 273/185 A

[58] Field of Search ..... 273/181 H, 181 R, 35 R, 273/183.1, 184 R, 185 R, 185 B, 358, 371, 26 R, 26 A

[56] References Cited

U.S. PATENT DOCUMENTS

| | | | |
|---|---|---|---|
| 2,581,738 | 1/1952 | Williams | 273/181 H |
| 3,559,996 | 2/1971 | Hopp | 273/181 H |
| 3,727,069 | 4/1973 | Crittenden, Jr. et al. | 273/371 |
| 3,837,655 | 9/1974 | Angelos | 273/181 H |
| 4,150,825 | 4/1979 | Wilson | 273/181 H |
| 4,437,672 | 3/1984 | Armantrout et al. | 273/181 H |
| 4,542,906 | 9/1985 | Takase et al. | 273/181 H |
| 4,563,005 | 1/1986 | Hand et al. | 273/181 H |
| 4,770,527 | 9/1988 | Park | 273/181 H |
| 4,949,972 | 8/1990 | Goodwin et al. | 273/181 H |

FOREIGN PATENT DOCUMENTS

| | | | |
|---|---|---|---|
| 0044198 | 2/1990 | Japan | 273/371 |

*Primary Examiner*—Jessica J. Harrison

*Attorney, Agent, or Firm*—Knobbe, Martens, Olson & Bear

[57] ABSTRACT

A sports simulator has a housing and two arrays of IR receivers and emitters positioned in the housing. A launch area is established near one end of the housing, and a user can launch an object such as a golf ball located in the launch area and drive the ball into the housing through the planes defined by the arrays of emitters and against a screen positioned at one end of the housing. A computer is connected to the IR receivers, which detect the passage of the object through the respective plane. Based upon the signals from the receivers the computer, using triangulation techniques, determines the horizontal and vertical position, as well as the velocity, of the object. The computer can also determine the spin of the golf ball, and cause an image of the golf ball, as it would have appeared travelling away from the golfer had it not encountered the screen, to be displayed on the screen.

53 Claims, 11 Drawing Sheets

SPORTS SIMULATOR

MICROFICHE APPENDIX

The appended microfiche appendix, consisting of 78 pages of source code in the "C" language, is fully incorporated herein.

FIELD OF THE INVENTION

The present invention relates generally to computer-based sports simulators, and more particularly to systems for simulating the flight of objects such as balls. In particular, the invention relates to golf simulators.

BACKGROUND

Many sports are based upon the use of objects for achieving a goal. For example, baseball games revolve around the handling of a baseball. Likewise, hockey, soccer and tennis are games which rely heavily on skills of handling hockey pucks, soccer or tennis balls, respectively. Sports such as these have continued to grow in popularity over the recent years. One sport which is exemplary of the way in which these sports have developed, and which serves as an example of the application of the present invention to various sports, is golf.

Golf is a sport that is continuing to grow in popularity. One of golf's main attractions to enthusiasts is the continual challenge of improving one's game. Indeed, even for the most seasoned professional, it is a virtual impossibility to golf a perfect round. Another attraction of golf is that the field of play constantly changes as the golfer progresses through the golf course and, consequently, the golfer 's interest is held during play.

Not surprisingly, to become an adept golfer and to maintain golfing proficiency, a significant amount of practice is required. Golf practice preferably exercises the golfer's ability in all facets of the game, including putting, pitching, and driving.

To improve their golf ball driving capability, many golfers spend hours hitting golf balls at outdoor driving ranges. These driving ranges include open areas hundreds of yards long down which the practicing golfers can drive golf balls. Typically, the golfer will purchase a bucket of range golf balls and sequentially drive the golf balls downrange. A golf course employee is ordinarily assigned to periodically collect the driven golf balls.

While driving ranges are excellent practice forums, they have certain drawbacks. Foremost among them is that because of their large size, most driving ranges must be outdoors, making them effectively unusable during periods of inclement weather. Also, driving ball after ball down the same driving range can become tedious.

Accordingly, golf training devices have been introduced for providing an indoor facility in which a golfer can practice golfing, including driving golf balls. One example of such a device is disclosed in U.S. Pat. No. 4,150,825 to Wilson for a golf game simulating apparatus. According to the Wilson invention, an enclosure is provided into which a golfer can drive a ball against a screen, and the image of a fairway is projected onto the screen. Prior to hitting the screen, the ball travels through three planes that are bounded by three sets of motion sensors. The sensors provide a signal to the computer when the ball passes through their respective plane. Based upon the signal from the sensors, the computer determines the trajectory the ball would have had if the ball had not been stopped by the screen. The computer then causes a video image of the ball to be projected on the screen, illustrating the balls' travel down the fairway.

Unfortunately, the Wilson device has several drawbacks. For example, the Wilson device cannot compute and display the path of a putted golf ball. The Wilson device also does not take into account the influence of obstacles such as trees on the travel of the ball. Also, the Wilson device requires the use of three arrays of sensors, which increases the complexity of the device. Further, the Wilson device cannot easily and quickly be erected and disassembled.

Accordingly, it is an object of the present invention to provide an athletic game simulator which can be played indoors. It is another object of the present invention to provide an athletic game simulator which provides a realistic, real-time video display of a physical object that is used in the athletic game, such as a putted or driven golf ball travelling a computed trajectory. Still another object of the invention is to provide such a simulator which requires a minimum number of sensor arrays to accurately accomplish its purpose, thereby minimizing its complexity and cost. A further object of the present invention is to provide an athletic game simulator which can be relatively easily assembled. Yet another object of the present invention is to provide an athletic game simulator which is easy to use and cost-effective to manufacture.

SUMMARY

An athletic game simulation system includes a housing forming an enclosure that has an area for launching a projectile, such as a launch or tee area at one end of the enclosure and a screen at the opposite end of the enclosure from the tee area. An athlete can drive, hit, putt, roll, kick, or throw a ball from the tee area against the screen, and a video image of the ball travelling away from the tee area along the trajectory it would have had if it had not hit the screen is projected onto the screen.

In the preferred embodiment, the simulation system simulates a golf game. A golfer can drive a golf ball from the tee area into the screen. Two arrays of optical receivers are positioned on the inner walls of the housing, and the arrays of receivers define respective first and second planes which are distanced from the tee area and through which the golf ball travels before the golf ball strikes the screen.

First and second emitters for transmitting electromagnetic radiation, preferably infrared (IR) radiation, are also positioned on the inner wall of the housing in the respective first and second planes. At least some of the receivers in the first plane are positioned to receive the electromagnetic radiation from the first emitter and to generate respective signals in response thereto. Preferably, a plurality of emitters are positioned on the housing in the first plane, such that each receiver in the first plane is in line-of-sight with at least one emitter. Likewise, at least some of the receivers in the second plane are positioned to receive the electromagnetic radiation from the second emitter and to generate respective signals in response thereto. Preferably, a plurality of emitters are positioned on the housing in the second plane, such that each receiver in the second plane is in line-of-sight with at least one emitter in the second plane.

A computer is electrically connected to both arrays of receivers for producing an estimate of the position, spin and velocity of the ball in response to the signals from the receivers, and for causing a video projector to project a video display of a predetermined golf course on the screen. To this end, the image of one or more predetermined golf courses is stored in the computer's electronic memory, and the computer causes a video projector to project an image of the portion of the golf course as would be seen from the tee area onto the screen. The computer also causes the video projector to project on the screen a video display of the golf ball as it would have travelled along a computed trajectory down the displayed golf course, if it would have flown into the scene depicted on the screen.

In one presently preferred embodiment, an electrical control circuit is provided, and the computer orders the control circuit to cause the emitters in the first plane to sequentially transmit pulses of infrared (IR) radiation. For each transmitted pulse, receivers that are in the same plane as the pulse transmitting emitter receive the IR transmission. Each selected receiver, through a signal conditioning, amplifying, and converting circuit, in turn sends a signal to the electrical control circuit, indicating either that the receiver has detected the IR transmission (i.e., that nothing has been interposed between the emitter and the receiver), or that the IR transmission has not been detected by the receiver (i.e., that an object, e.g., a golf ball, has interrupted the line-of-sight between the emitter and the receiver). The control circuit sends the signals from the receivers to the computer.

The computer synthesizes the signals from the receivers and computes whether an object (e.g., a golf ball) has passed through the first plane. If an object has passed through the first plane, the computer determines where, in x-y coordinates, the golf ball passed through the plane, using standard triangulation techniques. The computer also identifies a time value designating when the ball passed through the plane. Also, in the event that a golf ball has passed through the first plane, the computer activates the emitters in the second plane. The operation of the emitters and receivers in the second plane is substantially identical to the operation of the emitters and receivers in the first plane. Accordingly, the computer can determine where the golf ball has passed through the second plane, in x-y coordinates, as well as when the ball passed through that plane. Based upon the computed positions of the golf ball and the time values designated as it passed through the two planes, the computer determines the velocity (i.e., speed and direction) of the golf ball.

After the golf ball strikes the screen, it rebounds back through the second plane, and the receivers in the second plane sense the passage of the golf ball through the second plane. The computer determines where, in x-y coordinates, the golf ball passed through the second plane on the rebound. Based upon the difference between the positions of the golf ball as it passed through the second plane before and after the ball hit the screen, the computer determines the spin of the ball, and thus the amount of hook or slice and/or overspin or underspin the ball had. A golfing simulation program, such as the "Links" program sold by Access Software, Inc., of Salt Lake city, Utah is stored in the computer. The computer sends the computed position and velocity of the golf ball and computed spin of the ball to the "Links" program, and the "Links" program causes the video projector to project a video image of the golf ball on the screen as the golf ball would have appeared travelling down the golf course along the computed trajectory. The details of the structure of the present invention, as well as the operation thereof, can best be understood by reference to the accompanying drawings, in which like numerals refer to like parts.

DESCRIPTION OF THE PREFERRED EMBODIMENT

Figure 1:
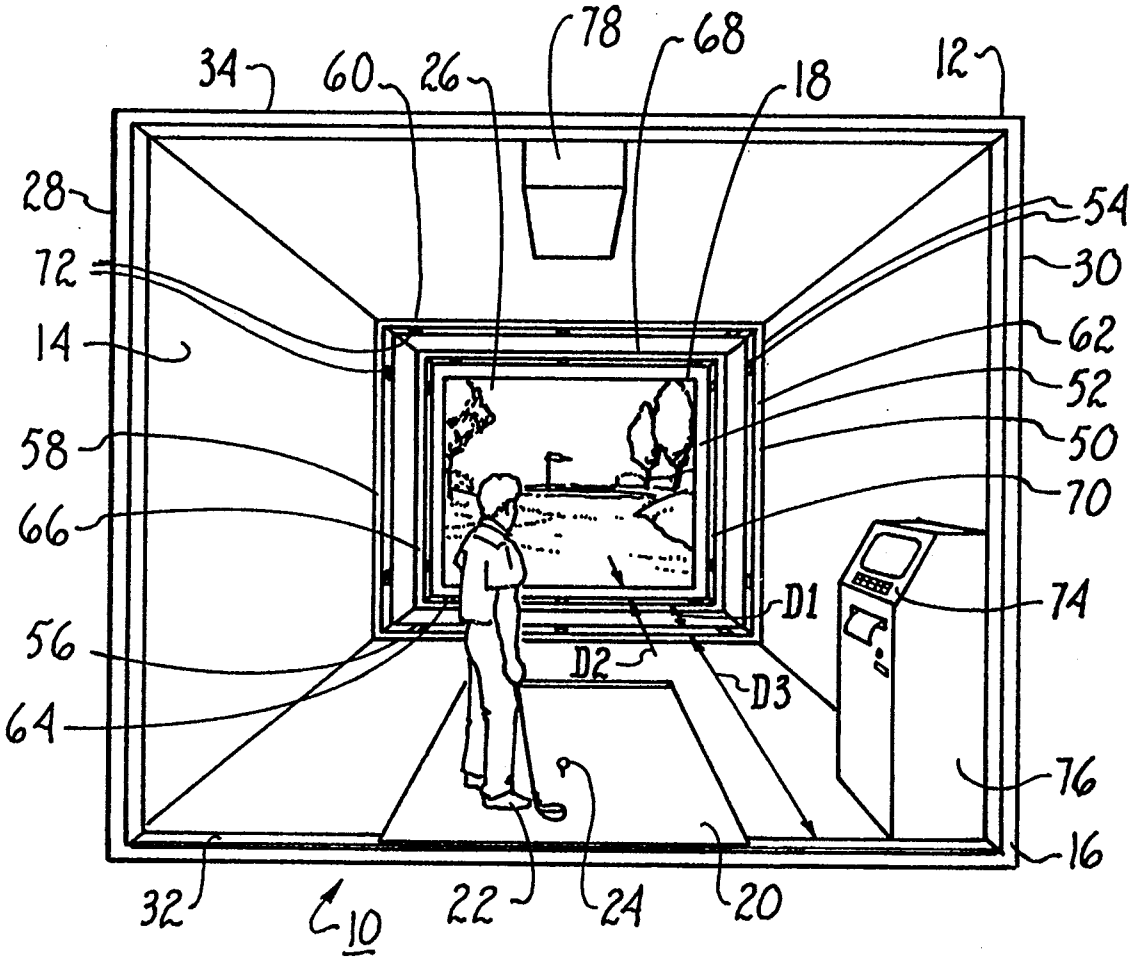
FIG. 1 is a perspective view of the sports simulator system of the present invention.

Referring initially to FIG. 1, a sports simulator system configured for simulating a golf game is shown, generally designated 10. In the preferred embodiment shown, the system 10 includes an elongated parallelepiped-shaped housing 12 that defines an enclosure 14. The housing 12 has an open end 16 and a closed end 18. A tee area 20 is positioned near the open end 16, and a golfer 22 can drive, pitch, or putt a golf ball 24 into the enclosure 14 toward the closed end 18 of the housing 12.

To cover the closed end 18, a screen 26 is positioned on the housing 12 and is distanced from the tee area 20. The screen 26 is made of a shock absorbing material that is suitable both for stopping a golf ball, and for functioning as a substrate on which a video image can be projected. In one presently preferred embodiment, the screen 26 is white, and is made of a vinyl-type material marketed as Ultra-Flex TM by Leder-Burnell of Huntington Park, Calif.

FIG. 1 also shows that the housing 12 has two side walls 28, 30, a floor wall 32, and a ceiling wall 34. The walls 28, 30, 32, 34 are preferably made of a lightweight, strong composite material, and can be easily and quickly joined together to facilitate rapidly erecting and disassembling the housing 12.

Figure 2:
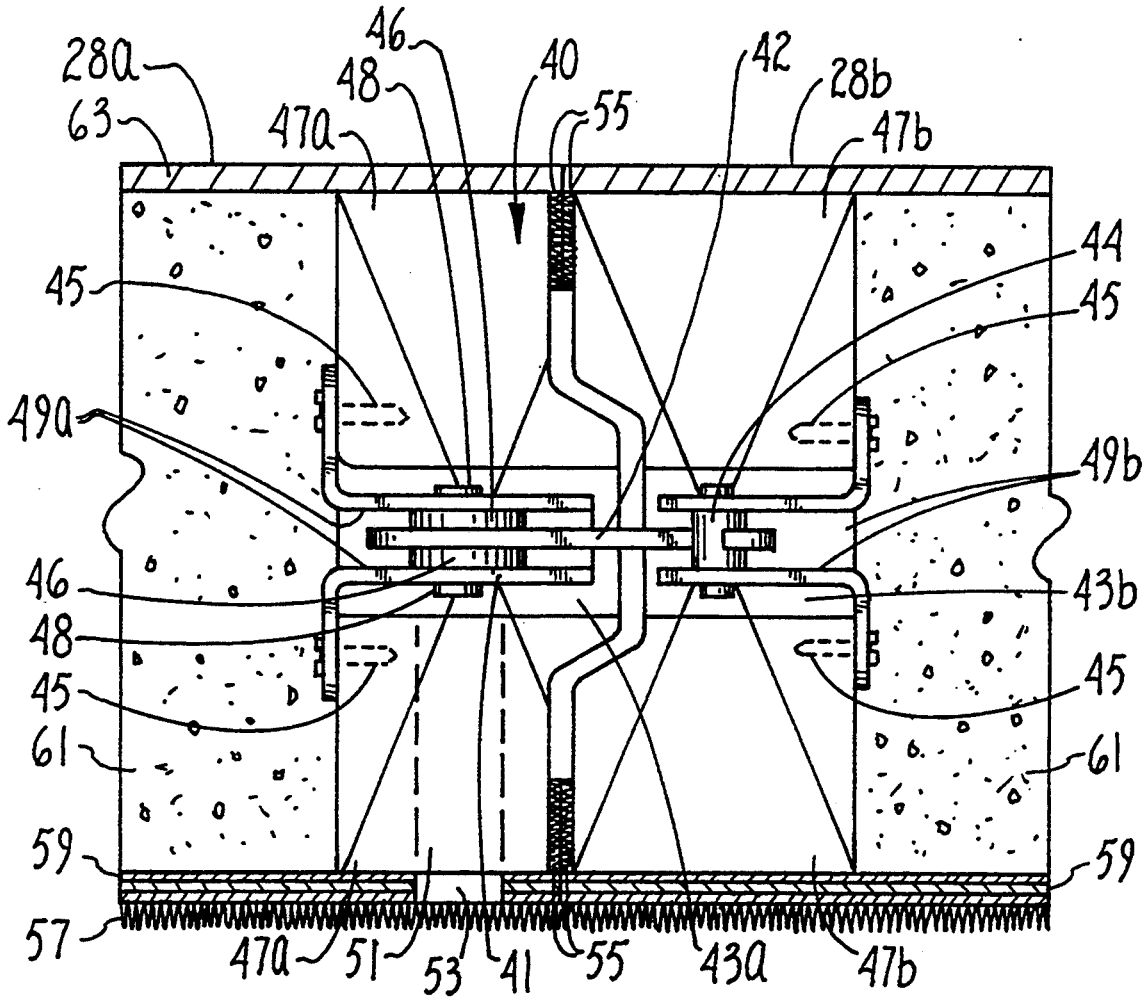
FIG. 2 is a top plan view of a portion of a wall of the housing of the sports simulator system, illustrating the joiner member which ties adjacent wall panels together.

To more particularly understand the construction and joining of the walls 28, 30, 32, 34 of the housing 12, reference is briefly made to FIG. 2, wherein it is seen that the side wall segment 28A is joined to another wall segment 28B or to another adjacent wall such as the ceiling wall 34 by at least one joiner member, generally designated 40, and preferably by a plurality of joiner members (not shown).

For purposes of discussion the use of the joiner member 40 in securing adjacent wall segments is described. In the presently preferred embodiment, the joiner member 40 is the 1151 series panel fastener made by Kason of Shenandoah, Ga. As envisioned by the present invention, the joiner member 40 includes a hook portion 41 that extends within a recess 43A in the side wall 28A, and is secured by conventional means such as screws 45 to an edge member 47A which, in one preferred embodiment, is comprised of wood. The hook portion 41 includes a steel hook 42 which secured to a camming member 46 which, itself, is pivotally connected to a pair of brackets 49A so as to rotate about an axis at the center of the camming member 41, extending between the brackets 49A.

The hook 42 can be pivoted to engage a pin 44 which is mounted in a recess 43 in the wall segment 28B. The pin 44 extends between a pair of brackets 49B which are secured by conventional means such as screws 45 to an edge member 47B which, in one preferred embodiment, is comprised of wood.

Once engaged with the pin 44, the hook 42 can be drawn inwardly, i.e., toward the side wall segment 28A, to securely fasten the side wall segment 28A to the side wall segment 28B. To this end, the camming member 46 is engaged with the hook 42, and the camming member 46 can be rotated to in turn urge the hook 42 inwardly toward the side wall 28. Specifically, the camming member 46 has a cammed periphery that is joined to the hook 42, so that as the camming member 46 is rotated, the hook 42 is drawn inwardly toward the side wall 28.

To permit rotating the camming member 46, the camming member 46 has a socket 48, and an Allen wrench (not shown) can be inserted into the socket located within an axle 48 and manipulated as appropriate to tighten or loosen the hook 42 for respective assembly or disassembly of the housing 12. Access to the socket by the allen wrench is achieved via an aperture 51 in the edge member 47A, which may be covered by a cap 53 in the wall segment 28A. Positive contact between adjacent wall segments 28A and 28B is achieved by providing gaskets 55 preferably comprised of resilient matter such as rubber along the outward portion of each edge members 47A and 47B, with the gaskets 55 achieving a positive contact with each other as the wall segments 28A, 28B are drawn together by the joiner member 40.

It will be recognized by those skilled in the art that other fastening means may be used to join the walls 28, 30, 32, 34 of the housing 12, and that above joiner member 40 is an example of an advantageous quick-connect, quick-disconnect fastening means. For example, each of the walls 28, 30, 32, 34 can be attached to its adjacent walls by nailing, screwing, or otherwise bonding the walls together.

Preferably, the walls 28, 30 32 and 34 of the housing 12 are constructed to minimize noise within the housing 12, and to absorb energy of impact with objects such as balls that are hit or deflected against them. In particular, in one preferred embodiment of the invention, the walls 28, 30, 32 and 34 include an inner surface 57 formed of carpet; an inner support 59 of 0.25" ACX plywood, although material such as 0.032" aluminum can alternatively be used; a central interior section 61 comprising material such as urethane in walls 28, 30 and 34, and styrene cooler in the floor 32; and an outer support 63 of 0.032" aluminum, although 0.25" ACX plywood may alternatively be used.

Referring back to FIG. 1, two arrays 50, 52 of electromagnetic radiation receivers 54 are mounted on the interior surfaces of the walls 28, 30, 32, 34 of the housing 12. Preferably, each receiver 54 is substantially identical to the other receivers 54, and the receivers 54 can detect infrared (IR) radiation and generate an electrical signal in response thereto. In one presently preferred embodiment, each receiver 54 is a type BPW 34F IR receiver manufactured by Seimens.

As shown in FIG. 1, the arrays 50, 52 define respective planes. More particularly, each array 50, 52 defines a respective plane that intersects the housing 12, and the intersection between the plane and the housing 12 defines a polygon. The arrays 50, 52 thus define the edges of respective polygons. In the preferred embodiment, the polygons are squares, and the planes defined by the arrays 50, 52 are substantially perpendicular to the longitudinal axis of the housing 12. In the embodiment shown, the distance D1 between the planes defined by the arrays 50, 52 is about 48 inches. Also, the distance D2 between the plane defined by the array 52 and the screen 26 is about 8 inches, and the distance D3 between the plane defined by the array 50 and the tee area 20 is about 66 inches, with the distances D1, D2, D3 being established in other embodiments as appropriate for the particular configuration of the system 10.

For purposes of the present invention, the sides of the squares defined by the arrays 50, 52 of IR receivers establish poles. Specifically, the array 50 includes first through fourth poles 56, 58, 60, 62, and the array 52 includes fifth through eighth poles 64, 66, 68, 70. Additionally, each array 50, 52 includes at least one electromagnetic radiation emitter 72, which is preferably an IR emitter, and each IR emitter 72 is in line-of-sight with at least one IR receiver 54 that is positioned in a different pole in the same array as the particular emitter 72. In one presently preferred embodiment, each IR emitter is a type L2168 emitter made by Hamamatsu.

In the embodiment shown in FIG. 1, the distance between adjacent receivers 54 in the same pole is about 1.5 inches. Also, in the embodiment shown, 10 emitters are used in each array 50, 52. These emitters are physically positioned about their array so as to give sufficient coverage over the entire array, and maximum detection in areas where balls are supposed to pass through. The distance from the end of a particular pole 56, 60, 64, 68, and the receiver 54 in that pole that is immediately adjacent the end of the pole is about 0.25 inches. The location of the emitter 72 with respect to the particular pole 56, 60, 64, 68 is based upon the strategic positioning of the emitter 72 as explained above. On the other hand, the distance from the end of a particular pole 58, 62, 66, 70, and the receiver 54 in that pole that is immediately adjacent the end of the pole is about 0.75 inch. Once again the distance between the end of a particular pole 58, 62, 66, 70, and an adjacent emitter 72 in that pole that is based upon the strategic positioning of the emitter 72 as explained above.

Preferably, the first, third, fifth, and seventh poles 56, 60, 64 (comprising the floor and ceiling poles), 68 include ninety six (96) IR receivers 54 each, and three (3) IR emitters 72 each. Also, the second, fourth, sixth, and eighth poles 58, 62, 66, 70 (comprising the side poles) include seventy six (76) IR receivers 54 each, and two (2) IR emitters 72 each. The skilled artisan will appreciate, however, that the precise number of receivers 54 and emitters 72 will vary, and the distance between adjacent emitters 72 and adjacent receivers 54 will vary, based upon the size of the housing 12 and the degree of desired accuracy of the system 10 in computing the trajectory of the golf ball 24.

FIG. 1 also shows that the system 10 of the present invention includes a computer 74 which is electrically connected to each of the emitters 72 and receivers 54. The computer 74 can be a personal computer, such as an IBM compatible PC. In accordance with the present invention, the computer 74 is electrically connected to an electrical control circuit (not shown in FIG. 1), which circuit is more fully described below. The control circuit can advantageously be housed in a computer console 76, along with the computer 74, for compact unitary stowage of the electrical control systems of the present invention.

The computer 74 is also electrically connected to a video projector 78 (electrical connection not shown), and the projector 78 is oriented to project a video image on the screen 26 in response to signals from the computer 74. As shown in FIG. 1, the projector 78 is preferably mounted on the ceiling 34 of the housing 12 by bolting the projector to brackets (not shown) and then bolting the brackets to the ceiling 34. In one presently preferred embodiment, the projector 78 is a type 3 tube projector made by Pulsar.

Figure 3:
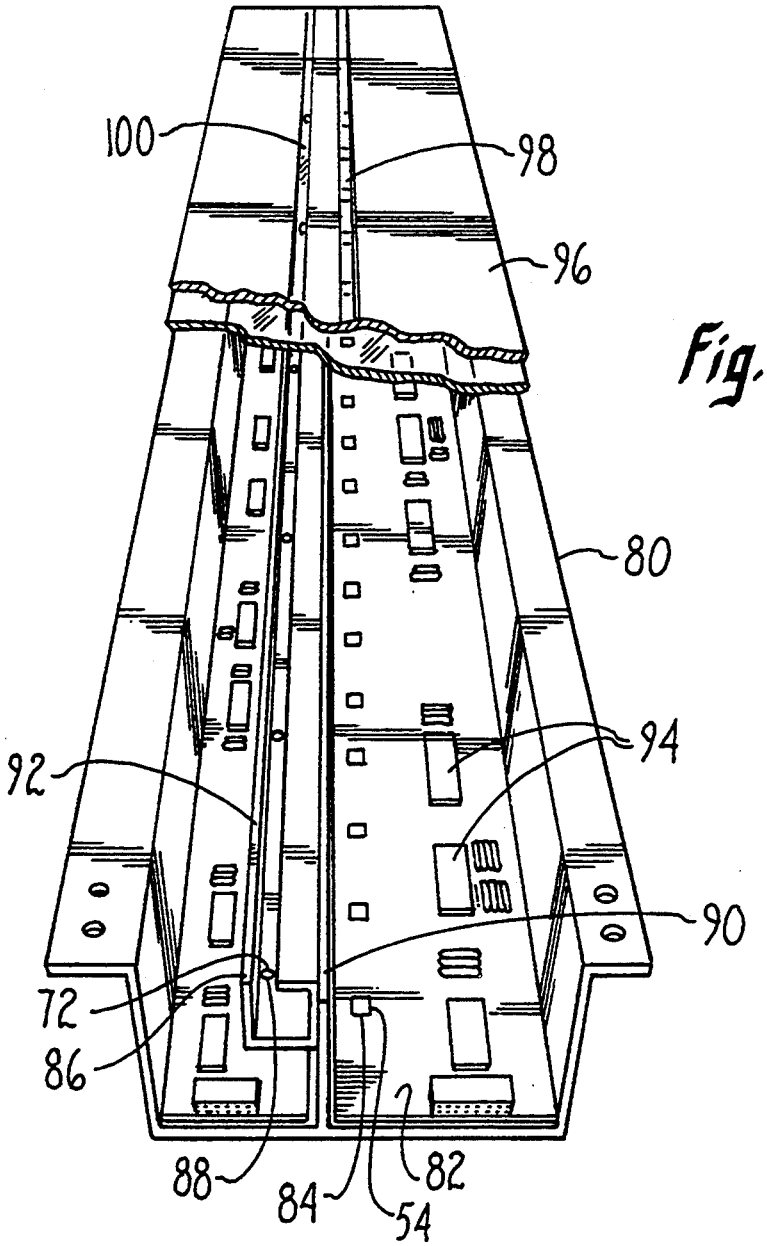
FIG. 3 is a perspective view of a portion of one array of infrared (IR) emitters and receivers, with portions cut away for clarity.

Now referring to FIG. 3, the construction of a portion of the pole 56 of the present invention can be seen. It is to be understood that the construction of the poles 58–70 is substantially identical to the construction of the pole 56, with the exception noted above that the floor and ceiling poles 56, 60, 64, 68 have more receivers 54 and emitters 72 than the side poles 58, 62, 66, 70.

As shown, the pole 56 includes a rigid, preferably metal base 80. The base 80 includes a receiver flange 82 formed with a plurality of holes 84 therein, so that a respective receiver 54 can be mounted on the base 80 in juxtaposition with a hole 84. Also, the base 80 has an emitter flange 86, and the emitter flange 86 is formed with a plurality of emitter openings 88. A respective emitter 72 can be mounted on the base 80 in juxtaposition with an emitter opening 88.

FIG. 3 further shows that the base 80 also includes a first blocking member 90 located so as to be interposed between the emitters 72 and the receivers 54 that are in the same pole to prevent saturating the receivers 54 with IR radiation from an immediately adjacent emitter 72. Also, the base 80 has a second blocking member 92 positioned so as to be on the side of the emitters 72 that is opposite the first blocking member 90. Additionally, integrated circuitry 94, which is the physical embodiment of much of the electrical control system discussed below, is mounted by well-known means on the base 80.

Still referring to FIG. 3, an opaque cover 96 can be mounted onto the base 80 by conventional means such as gluing the cover 96 to the base 80. As shown, the cover 96 has a first transparent, preferably polycarbonate window 98 for permitting infrared (IR) radiation external to the base 80 to impinge upon the receivers 54. Also, the cover 96 has a second transparent, preferably polycarbonate window 100 for permitting infrared (IR) radiation that is emitted from the emitters 72 to pass through the window 100.

The opaque cover 96 also acts as a baffle to direct light from the emitters 72 in the appropriate direction, and thereby prevent reflection of stray light from the emitters 72 at other places in the simulator 10. Such stray light can reflect off interior walls and affect the contrast of the ball shadows, thereby reducing system reliability. The opaque cover 96 also protects the electronics contained in the pole from damage due to impacts with objects such as balls hit into the simulator 10. The polycarbonate window 100 is preferably affixed to the inner surface of the cover 96 to cover the associated window hole in the cover 96. Recessing the window 100 in this manner protects it from contact with objects such as the ball, and thereby helps it to remain optically clear.

Figure 4:
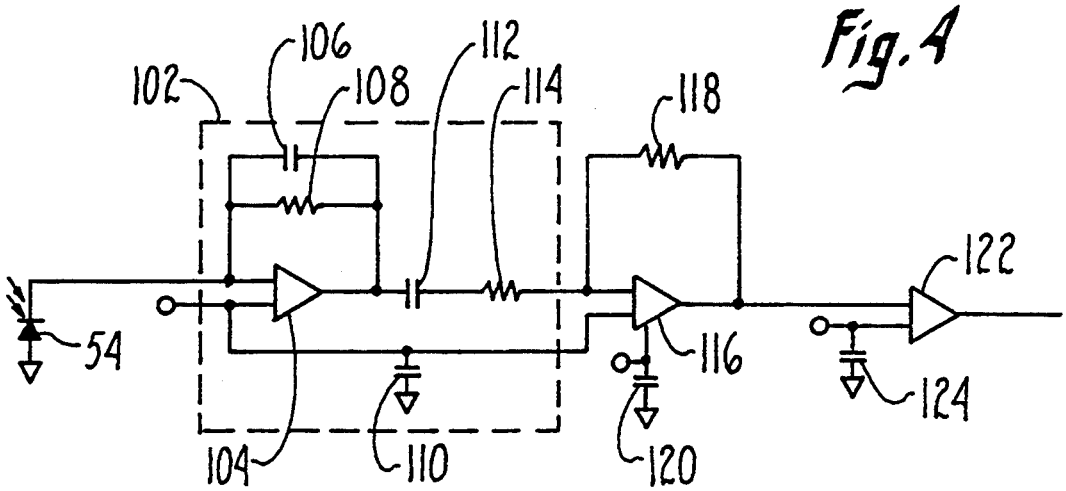
FIG. 4 is an electrical schematic diagram of the signal conditioning circuitry associated with one of the IR receivers.

Referring now to FIG. 4, the details of the electronic signal conditioning circuitry contained on receiver/emitter control board 130, for a single receiver can be seen. Preferably, each receiver/emitter control board 130 contains several of these circuits of FIG. 4, each connected to a separate receiver. For example, in one preferred embodiment, each control board 130 contains sixteen of the circuits of FIG. 4. The signal conditioning circuits of FIG. 4 are connected to a signal communication circuit which is also preferably contained on the board 130 for accumulating the signals from the several signal conditioning circuits and communicating them to the serial control board 128 for processing by the C30 board 126. Such a signal communication circuit is also preferably contained on each communication control board A0–B3, and thus, this circuit will be more fully described hereafter with reference to FIG. 7A. The skilled artisan will appreciate that FIG. 4 shows but one particular design of the signal conditioning circuit of the present invention, and that other circuits may be used without departing from the scope of the present invention.

As shown in FIG. 4, each receiver 54 is connected to a transimpedence amplifier 102 which converts the electrical current signal from the receiver 54 to a voltage signal. In one presently preferred embodiment, the transimpedence amplifier 102 includes an operational amplifier 104 of the type marketed as LF347N made by National Semiconductor, a 2 picofarad capacitor 106, and a 220K ohm resistor 108 are used to set the gain of the first stage operational amplifier 104.

As shown, the capacitor 106 and resistor 108 are connected in parallel with the operational amplifier 104. Also, the transimpedence amplifier 102 includes a 0.1 μfarad capacitor 110 which is connected to ground and a 6800 picofarad capacitor 112 in series with a 1K ohm resister 114, to form a high pass filter.

From the transimpedence amplifier 102, the voltage signal is conducted to a voltage amplifier 116. In one presently preferred embodiment, the voltage amplifier 116 is a second LF347N operational amplifier, and an 8.2K ohm resister 118 is connected in parallel with the voltage amplifier 116, thereby forming a feedback resistor for setting amplifier gain. Also, the voltage amplifier 116 is electrically connected to a 0.1 microfarad capacitor 120 and thence to ground.

From the voltage amplifier 116, the signal is conducted to a comparator 122 which essentially functions as an analog-to-digital converter. Preferably, the comparator 122 is an LM339 comparator, made by National Semiconductor. When the voltage signal from the voltage amplifier 116 has an amplitude greater than a predetermined set point, the comparator 122 outputs a digital "0", indicating that the receiver 54 detected a burst of IR radiation from an emitter 72 (and, hence, that no object was interposed in the line-of-sight between the receiver 54 and the emitter 72). Otherwise the comparator outputs the digital "1" indicating that the receiver 54 did not detect a burst of IR radiation from an emitter 72 (and, hence, that an object was interposed in the line-of-sight between the receiver 54 and the emitter 72).

As shown, the comparator 122 is also connected to ground through a 0.1 microfarad capacitor 124. The output of the comparator 122 is conducted to a parallel-in, serial-out shift register, the operation and construction of which is more fully described below.

The overall configuration of the signal processing circuitry of the present invention can be described by reference to FIG. 5. There, it is seen that the personal computer 74 is electrically connected to a control module, preferably a commercially available TMS320C30 board made by Wintriss Engineering of San Diego, Calif. (hereinafter referred to as the "C30 board 126"). The personal computer 74 can be any suitable computer, for example, an IBM compatible personal computer. The personal computer 74 is used as a user interface to give commands to the C30 board 126 and, specifically, to command the C30 board 126 to activate the electronic components of the present invention. In other words, the personal computer 74 activates the C30 board 126 and the C30 board 126 controls the operation of the electronic components of the present invention.

The C30 board 126 is electrically connected to a serial controller 128 which will be described in greater detail with reference to FIG. 6 below. The serial controller 128 is, in turn, electrically connected to eight communications boards designated respectively A0, B0, A1, B1, A2, B2, A3, B3. Each communications board A0, B0, A1, B1, A2, B2, A3, B3 controls the communication of electrical signals to and from the receivers 54 and emitters 72 of a respective one of the eight poles 56–70 of the present invention.

More particularly, the communications board B0 controls the communication of electrical signals to and from the receivers 54 and emitters 72 of the pole 56 in the first array 50, and the communications board B1 controls the communication of electrical signals to and from the receivers 54 and emitters 72 of the pole 60 in the first array 50. Also, the communications board B2 controls the communication of electrical signals to and from the receivers 54 and emitters 72 of the pole 64 in the second array 52, and the communications board B3 controls the communication of electrical signals to and from the receivers 54 and emitters 72 of the pole 68 in the second array 52. Thus, the communications boards B0–B3 control communications to and from the 96 receivers 54 and three emitters 72 in each of the ceiling and floor poles in the arrays 50, 52.

On the other hand, the communications board A0 controls the communication of electrical signals to and from the receivers 54 and emitters 72 of the pole 58 in the first array 50, and the communications board A1 controls the communication of electrical signals to and from the receivers 54 and emitters 72 of the pole 62 in the first array 50. Also, the communications board A2 controls the communication of electrical signals to and from the receivers 54 and emitters 72 of the pole 66 in the second array 52, and the communications board A3 controls the communication of electrical signals to and from the receivers 54 and emitters 72 of the pole 70 in the second array 52. Thus, the communications boards A0–A3 control communications to and from the 76 receivers 54 and two emitters 72 in each of the side wall poles in the arrays 50, 52.

Preferably, the communications boards B0, B1, B2, B3, A0, A1, A2, A3 are physically mounted on a base, such as the base 80, which makes up one of the arrays 50, 52. The construction and operation of the communication boards A0–B3 will be disclosed further below in reference to FIG. 7.

Figure 5:
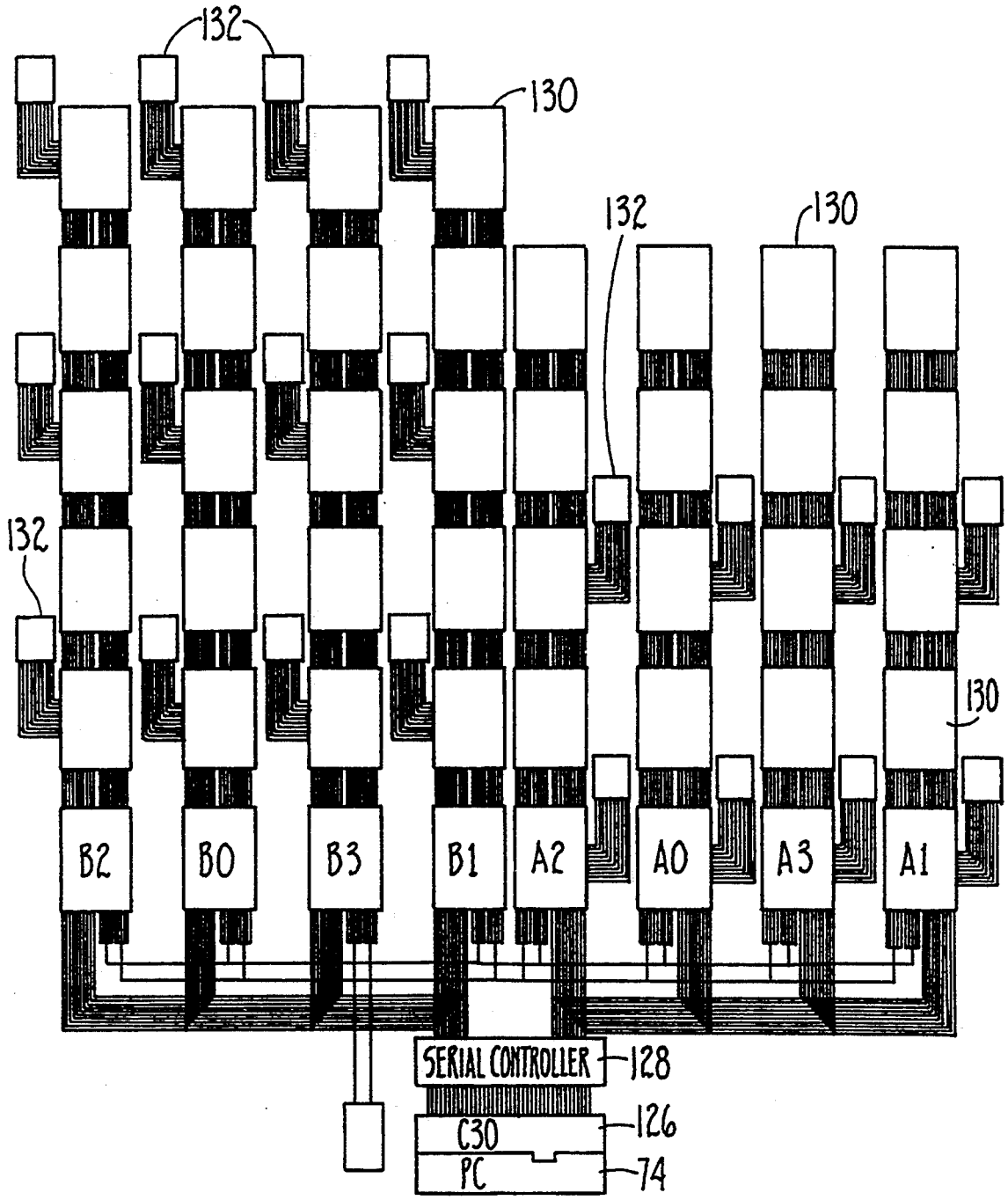
FIG. 5 is a block diagram showing the electrical control circuit of the present invention.

FIG. 5 further shows that each communication board is electrically connected to a series of receiver/emitter control boards 130. Each communication board A0–B3 directly controls 16 receivers 54 and each of the receiver/emitter control boards 130 located on its pole. For example, each of the communication boards B1, B2, B0, B3 is associated with a ceiling or floor pole 56, 60, 64, 68, and each ceiling and floor pole has 96 receivers associated with it. Thus, each of the communications boards B0, B1, B2, B3 controls the communication of signals to and from 96 receivers 54.

On the other hand, each of the communication boards A0, A1, A2 and A3 has only four receiver/emitter control boards 130 associated with it for controlling a total of 76 receivers. This is because, as stated above, the communication boards A0, A1, A2, A3 are associated with the side poles 58, 62, 66, 70 of the 2 arrays of emitters which, as also stated above, have 76 receivers each.

Further, three of the receiver/emitter control boards 130 associated with each of the "B" communications boards is electrically connected to an emitter control circuit 132. In contrast, only two of the receiver/emitter control boards 130 associated with each of the "A" communications boards is electrically connected to an emitter control circuit 132. This corresponds to the above-stated number of emitters 72 in each pole 56–70. The receiver/emitter control boards 130 and the emitter control circuits 132 are mounted on a base of an appropriate one of the arrays 50, 52, e.g., the base 80. Each communication control board A0–B3 is substantially identical to the other communication control boards. Also, each receiver/emitter control board 130 is substantially identical to the other receiver/emitter control boards, and each emitter control circuit 132 is substantially identical to the other emitter control circuits.

Thus, in response to commands from the C30 board 126, the serial controller 128 controls the transmission of infrared energy from the emitters 72 and the communication of electrical signals from the eight poles 56–70 of the present invention through the communication boards A0, A1, A2, A3, B0, B1, B2, B3 as more fully disclosed below.

Figure 6:
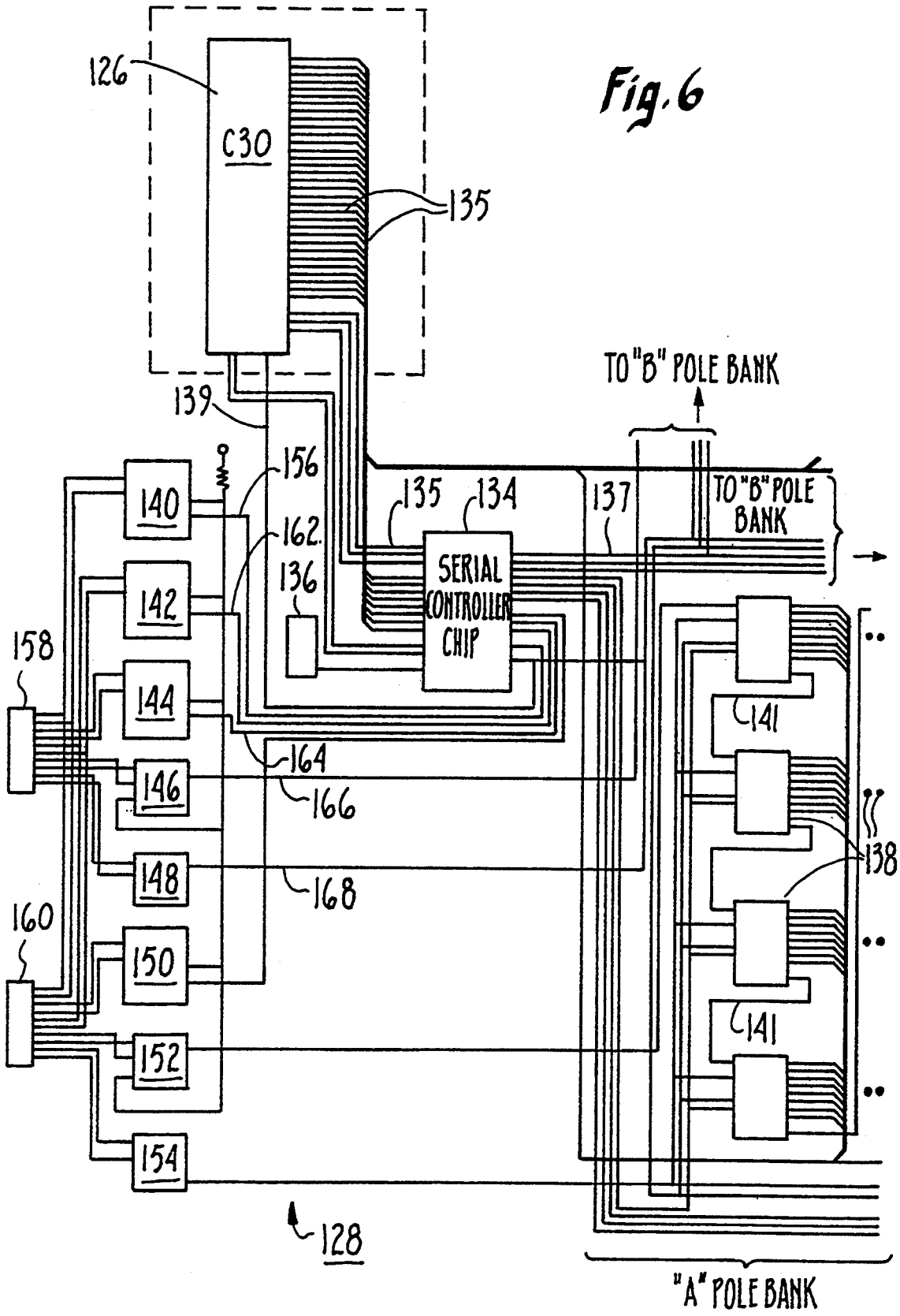
FIG. 6 is a block diagram showing the details of the serial control board of the present invention.

Now referring to FIG. 6, the details of the serial controller board 128 can be seen. As shown, the serial controller board 128 includes a serial controller chip 134. The serial controller chip 134 is a programmed logic chip, preferably of the type EP 5128 made by Alterra Corporation, and is electrically connected to the C30 board 126 via a plurality of command lines 135 by means well-known in the art.

FIG. 6 shows that the serial controller chip 134 is electrically connected to a twenty (20) megahertz clock 136. Also, the serial controller chip 134 is connected to two banks ("A" and "B") of serial-in parallel-out shift registers 138 via a plurality of read lines 137 by means well-known in the art (only "A" bank shown; successive shift registers 138 in each row of "A" bank designated by dots). Also, the C30 board 126 is electrically connected to one of the clock lines 137 (designated the "done" line for purposes of the present invention) via a data pick-up line 139.

While only the "A" bank is shown in FIG. 6, it is to be understood that the "B" bank is in all respects identical to the "A" bank, with the exception that each row in the "B" bank includes four serial-in parallel-out shift registers 138.

The "A" and "B" banks of shift registers 138 essentially accept data from a predetermined side pole 58, 62, 66, 70 or top/bottom pole 56, 60, 64, 68, respectively. Stated differently, the "A" bank of shift registers 138 corresponds to the four side poles 58, 62, 66, 70 and accepts data from their respective communications control boards A0–A3, and the "B" bank of shift registers 138 corresponds to the ceiling and floor poles 56, 60, 64, 68 and accepts data from their respective communications control boards B0–B3. In other words, the "A" bank of shift registers 138 accepts data from a predetermined one of the poles 58, 62, 66, 70 and the "B" bank of serial-in parallel-out shift registers 138 accepts data from a predetermined one of the poles 56, 60, 64, 68.

Each serial in parallel out shift register 138 is preferably a chip designated 74HC595 made by Texas Instruments Corporation. As shown, the shift registers 138 are "daisy chained" together through lines 141 so that the shift registers 138 are serially connected. In this manner, data comprising signals from the receivers of each pole is serially shifted into and through the shift registers 138. This data identifies whether the particular receiver has detected the presence of an object, such as a ball, passing between that receiver and the receiver that was fired. The serial organization of the data in the system creates a data string which can be evaluated as more fully described below to identify those receivers which have detected the presence of the object.

FIG. 6 also shows that to effect communication between the serial controller chip 134 and the communication boards A0–B3, and to transmit signals from the communication boards A0–B3 to their respective bank of serial-in parallel-out shift registers 138, a plurality of line drivers 140–154 are provided. The purpose of the line drivers 140–154 is to aid in the transmission of electrical signals between the serial controller board 128 and each one of the communication control boards A0–B3 that are located in their respective pole and are thus distanced from the serial control board.

In the particular embodiment shown, the line drivers 140, 142, 144, 150 are type DS3695 line drivers made by Texas Instruments Corporation, and the line drivers 146, 148, 152, 154 are type 55ALS195 line drivers made by Texas Instruments Corporation. As shown, the input of the line driver 140 is electrically connected to the serial controller chip 134 via a line 156, and the output of the line driver 140 is connected to each of two connectors 158, 160 for transmitting a first clocking signal ("RCLK") from the chip 134 to the communication control boards A0–B3 via the connectors 158, 160. The connector 158 is electrically connected to the "B" communication control boards (FIG. 5), and the connector 160 is electrically connected to the "A" communication control boards (FIG. 5).

As also shown, the input of the line driver 142 is electrically connected to the serial controller chip 134 via a line 162, and the output of the line driver 142 is connected to each of the two connectors 158, 160 for transmitting a second clocking signal ("TCLK") from the chip 134 to the communication control boards A0–B3 via the connectors 158, 160.

FIG. 6 additionally shows that the line driver 144 is connected to the connector 158 and to a command line 164 that leads to the serial controller chip 134. The line driver 144 transmits an emitter control signal ("TDATA") from the chip 134 to the "B" communication control boards. Further, the line driver 146 is connected to the connector 158 and to an input line 166 that leads to the "B" bank of serial-in parallel-out shift registers 138 for receiving signals ("RDATA") from the "B" communication control boards.

The line driver 148, as shown in FIG. 6, is electrically connected to the connector 158 and to the "B" bank of shift registers 138 via a clock line 168 for transmitting a synchronizing signal ("RLOOPCLK") to the "B" communication control boards.

The line driver 150 is electrically connected to the connector 160 and the serial controller chip 134 and functions, for the "A" communication control boards, in a manner analogous to the line driver 144, as described above in relation to the "B" communication control boards. Also, the line drivers 152, 154 are connected to the connector 160 and the "A" bank of serial-in parallel-out shift registers 138 for performing, for the "A" communication control boards, a function analogous to that described above for the line drivers 146, 148 in conjunction with the "B" communication control boards.

Figure 7A:
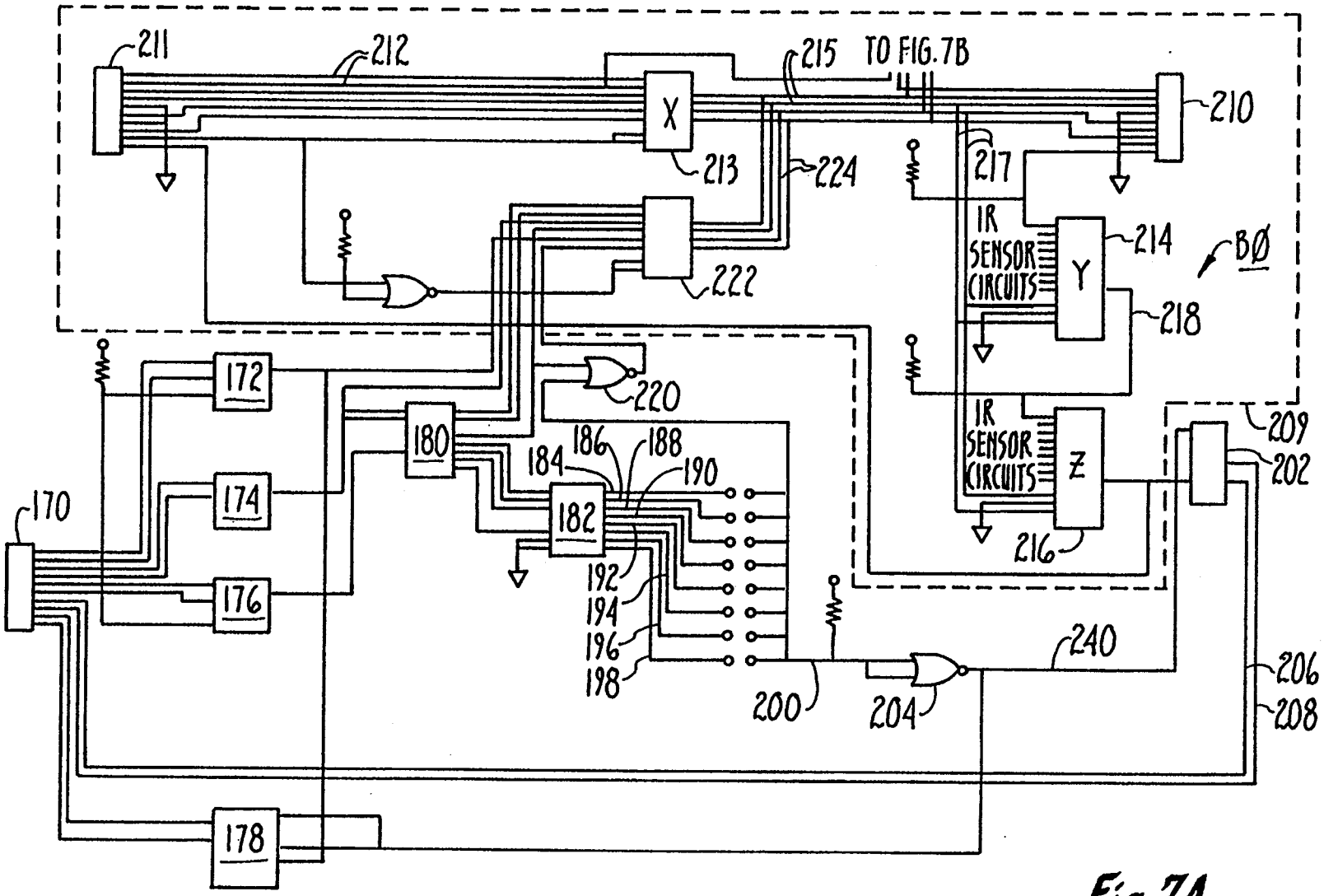
FIG. 7A is a block diagram showing the details of a first portion of a communication board of the present invention.
Figure 7B:
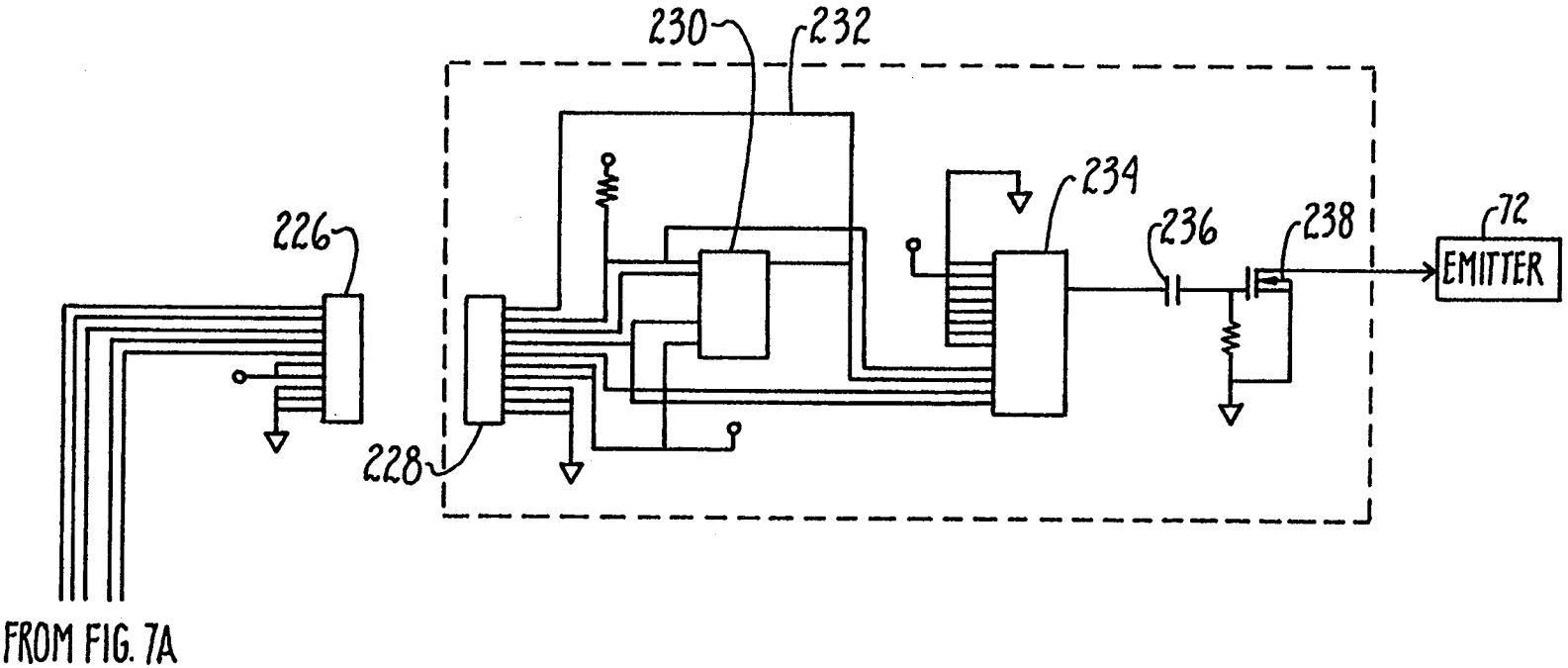
FIG. 7B is a block diagram showing the details of a second portion of a communication board shown in FIG. 7A.

Now referring to FIGS. 7A and 7B, the details of a single communications board, for example communications board B0, can be seen. It is to be appreciated that each communications board A0–A3 and B1–B3 is substantially identical to the communications board B0 in construction and operation. Further, each one of the communications boards A0–A3 and B1–B3 includes several of the signal conditioning circuits of FIG. 4 (as required to control those receivers directly connected to that communication board), as well as a signal communications circuit 209 (described below), which form the circuitry contained in the emitter/receiver control board 130. In addition to the circuitry which corresponds to that of the control boards 130, the communication board 130 includes circuitry necessary to transmit control signals from the serial control board 128 to the emitters 72 in the pole associated with the B0 board, and to relay signals in serial order from the receivers 54 in the pole associated with the B0 board back to the serial control board 128.

FIG. 7A shows that the communication control board B0 has a connector 170 for receiving electrical conductors running from the serial control board 128. The connector 170 is electrically connected to three line receivers 172–176 and a line driver 178. Each line receiver 172–176 is preferably of the type 55ALS195 made by Texas Instruments Corporation, and the line driver 178 is a type DS3695.

The line receiver 172 is connected to the "RCLK" timing signal from the connector 170, while the line receiver 174 is connected to the "TDATA" signal from the connector 170. Also, the line receiver 176 receives the "TCLK" timing signal from the connector 170. On the other hand, the line driver 178 is provided and connected as shown to the "RLOOPCLK" signal to counterbalance the effects on the circuit of transmission delay by synchronizing the "RCLK" signal with return pulses from the receivers 54, as more fully described below.

As shown, the line receivers 174, 176 are electrically connected to a serial-in, parallel-out shift register 180 preferably of the type 74HC164 made by Texas Instruments Corporation. In turn, the serial-in parallel-out shift register 180 is electrically connected to an address decoder chip 182 preferably of the type 74HC138 made by Texas Instruments Corporation. The output of the address decoder chip 182 is connected to eight leads 184–198, one of which (in the case of the B0 board, jumper lead 190) is jumpered as appropriate for the particular pole, the other leads being essentially open circuits. As shown in FIG. 8A, an output jumper lead 200 is electrically connected to a line driver 202 preferably through a 74HC02 chip 204 made by Texas Instruments Corporation. Also, two data leads 206, 208 from the connector 170 are connected to the line driver 202 for transmitting the receive signals "RDATA") between the line driver 202 and the connector 170. Preferably, the line driver 202 is a type DS3695, manufactured by Texas Instruments Corporation.

FIG. 7A further shows that the communications board B0 also includes a signal communication circuit, generally designated 209, which corresponds to the signal communication circuits 209 on each of the emitter/receiver control boards 130. The signal communication circuit 209 includes a second connector 210 and, if required, a third connector 211. Recall that the receiver/emitter control boards 130 associated with the communication control board B0 are connected in series. This series connection between the boards is accomplished by interconnection of their individual connectors 210 and 211. For example, for any given board B0, 30, the second connector 210 provides an interface to receiver/emitter control boards 130, if any, that are electrically upstream of the particular board associated with the connector 210. Also, the third connector 211 provides an interface to receiver/emitter control boards 130, or communications board B0, if any, that are electrically downstream of the particular board associated with the connector 211.

In the case of the B0 board, the second connector 210 receives input from the receiver-emitter control boards 130 that are associated with the communication control board B0. In particular, this connector 210 is electrically connected to the next board 130 up the line. As shown, a plurality of lines 215 extend from the second connector 210 to a buffer chip 213 of the type 74HC365, manufactured by Texas Instruments Corporation (designated "X" in FIG. 7A). A plurality of lines 213 extend from the third connector 211 to the buffer chip 213.

In turn, the buffer chip 213 is electrically connected, via lines 217, to a parallel-in serial-out shift register 214 (designated "Y" in FIG. 7A) of the type 74HC166 made by Texas Instruments Corporation. This shift register 214 is also serially connected to a second like shift register 216 (designated "Z" in FIG. 7A) via a line 218. Thus, the shift registers 214, 216 are serially connected to each other and to the shift registers (not shown) of the associated receiver/emitter control boards 130 through the second connector 210.

Each one of the shift registers 214, 216 receives input signals from eight of the signal conditioning circuits (FIG. 4) associated with the infrared receivers 54 of the present invention. As is known in the art, the parallel-in serial-out shift registers 214, 216 can receive data in parallel from their associated signal conditioning circuits and output this data in serial format. The parallel-in serial-out shift registers 214, 216 thus receive data from associated receiver 54 circuits, and serially transfer this data back through the circuitry described above through the connector 170 to the serial control board 128 for processing by the C30 board 126.

Having disclosed the portion of the communication control board B0 that is associated with the IR receivers 54, the details of the portion of the B0 board that is associated with an IR emitter 72 can be explained. As shown in FIG. 7A, the output jumper lead 200 is electrically connected to a NOR gate 220. Also, the NOR gate 220 accepts input from the shift register 180, as shown. When the NOR gate 220 receives both a signal from the shift register 180 ("LOADMODE") which indicates the proper time for an emission from any emitter 72, and a signal from the output jumper lead 200 that indicates the C30 board 126 has determined that an emitter 72 in the B0 pole will emit a burst of IR, the NOR gate 220 sends an emitter enable signal to a buffer chip 222. The buffer chip 222 functions as an amplifier and relays the signal from the NOR gate 220 as described below.

The buffer chip 222 can advantageously be of the type 74HC365 made by Texas Instruments Corporation. Further, the buffer chip 222 is electrically connected to the second buffer chip 213 via a plurality of lines 224.

FIG. 7B illustrates the emitter control circuit of control board 132, which interferes with the signal communication circuit 209 and which is also contained on the communication control board B0 when that board B0 is to be associated with an emitter 72 (FIG. 4). In this case, the output of the buffer chip 222 (and, hence, the output of the NOR gate 220) is electrically connected to an emitter port connector 226. The emitter port connector 226 is electrically connected to an emitter port receive connector 228, and signals from the emitter port receive connector 228 are sent to a shift register 230. Also, the shift register 230 receives a signal from the emitter circuitry (not shown) of the temporally precedent emitter 72 in the same pole as the shift register 230 (i.e., the emitter which emits IR in the cycle immediately preceding the cycle in which the shift register 230 is to initiate an emission). This signal is conducted from the circuitry of the temporally precedent emitter 72 to the shift register 230 through the connector 210 and through the emitter port connectors 226, 228, and indicates whether the temporally precedent emitter 72 has indeed "fired". Also, the shift register 230 sends a signal to the emitter control circuitry (not shown) of the temporally subsequent emitter 72 to indicate whether the emitter 72 associated with the shift register 230 has fired. The shift register 230 can advantageously be a chip of the type 74HC164.

As further shown in FIG. 7B, one lead 232 from the emitter port receive connector 228, as well as the output of the shift register 230, are sent to an emitter control chip 234 of the type 74HC151. The output of the emitter control chip 234 is sent through a 0.1 microfarad capacitor 236 and a mosfet N transistor 238 and thence to one of the IR emitters 72.

The operation of the electronic circuity described above can thus be appreciated in reference to FIGS. 6, 7A, and 7B. To initiate one cycle of IR emitter firings in, for example, the first array 50 of emitters 72 and receivers 54, the C30 board 126 writes a series of bytes to the serial controller chip 134. This loads a corresponding series of registers in the serial controller chip 134. The first register is a fire pole select signal which determines which pole 56–70 will fire, i.e., the pole from which an emitter 72 will emit IR radiation, one bit of which also configures the serial-in parallel-out shift registers 214, 216 to receive data from their receivers 54 ("LOAD MODE").

Also, the series of registers includes an emitter on time signal which determines how long the emitter 72 will emit IR radiation. The emitter on time signal essentially determines how many clock cycles, in 100 nanosecond increments, the selected emitter 72 will emit. In the presently preferred embodiment each emitter 72 emits IR radiation for 3.8 microseconds.

The series of registers also includes a read pole select which determines which of the poles 56–70 will be read. One presently preferred embodiment of the present invention envisions that two poles 56–70 will be read in any one cycle, with the two poles being selected to be generally opposite the pole in which the selected emitter is firing. In alternate embodiments, however, when an emitter 72 fires in one pole of an array 50, 52, the data from the receivers 54 in the remaining three poles or alternatively, in all of the poles, of the array can be read.

Further, the series of registers includes an emitter count and board count. The board count essentially tells the serial controller chip 134 how many bits to read back from the communication control board B0. The emitter count identifies which of the emitters on the pole is to be fired. This number is currently set to equal ninety six (96), to account for the maximum number of receivers 54 in any given pole. Finally, the series of registers includes a start signal.

Upon receipt of the start signal from the C30 board 126, the serial controller chip 134 toggles eight times, i.e., the serial controller chip sends out eight sequential bits on the "TCLK" line representing the fire pole select order. The bits are sent to the communications control boards A0–B3.

FIG. 7A shows that the TCLK signal is passed through the first connector 170 and line receiver 174 to the serial-in parallel-out shift register 180 and from thence to the address decoder chip 182. If the fire pole select signal indicated that the pole 56 associated with the B0 board shown in FIG. 8A is the pole that contains the emitter 72 to be fired, the fire pole select signal will be passed to the appropriate output port of the address decode chip 182 that corresponds to the line 190, i.e., the line that is jumpered. Otherwise, the fire pole select signal will not pass beyond the address decoder chip 182.

If the emitter 72 to be fired in the current cycle is in the B0 pole 56, the fire pole select signal is passed on to the AND gate 220. Also, the fire pole select signal is passed to the serial-in parallel-out shift registers 214, 216 via a line 240 and the line driver 202 to configure the shift registers 214, 216 to a load mode, wherein the shift registers 214, 216 are configured to receive data from the receiver 54 130 circuits associated with the particular shift registers 214, 216.

The NOR gate 220 outputs a zero signal (i.e., an "emitter enable" signal) only if two conditions are met. First, the fire pole select signal must be present at the NOR gate 220, thereby indicating that the B0 pole 56 contains the emitter 72 to be fired. Additionally, the "LOADMODE" signal must have been present in the "TDATA" fire mode select signal. Otherwise, the NOR gate 220 outputs a 1 which indicates that the emitter 72 to be fired is not in the B0 pole 56.

The emitter enable signal from the NOR gate 220 is conducted to the buffer chip 222 and from there to the emitter connectors 226, 228 (FIG. 7B) and the shift register 230 which controls the emitter 72 operation.

The serial controller chip 134 next transmits a fire signal through the "RCLK" line to the line receiver 172. This fire signal includes a bit representing how long the emitter 72 is to emit IR. The "RCLK" fire signal is in turn conducted to the buffer chip and thence to the emitter connectors 226, 228 shown in FIG. 7B.

It can now be explained that the shift register 230 causes the emitter 72 to fire if three conditions are met. First, the shift register 230 must receive a fire signal ("RCLK") from the serial controller chip 134. Also, the shift register 230 must receive an emitter enable signal from the NOR gate 220. Third, the shift register 230 must receive a bit from the adjacent receiver/emitter board 130 indicating that the temporally precedent emitter has fired, as described above.

After the emitter 72 fires, the shift register 230 will forward a "fired" bit to the control circuitry of the next emitter in the B0 pole 56 that is to fire. This "fired" bit indicates that the emitter 72 has fired so that the temporally subsequent emitter in the B0 pole will be set up to fire during the next fire order.

The operation described above applies to the B0 communication control board when the C30 board 126 has determined that the emitter 72 associated with the B0 board is to fire. In such an instance, the receivers 54 associated with the B0 board will not be set up to receive IR radiation. When the C30 board 126 has determined that the emitter 72 associated with the B0 board is not to fire, however, and that receivers 54 associated with the B0 board are to receive IR from an emitter in another pole (not shown in FIGS. 6, 7A, 7B), the IR receivers 54 must be set up to receive data.

To set up the IR receivers 54 in the B0 pole to receive data, the serial controller chip 134 pulses eight times to send an 8 bit "TDATA" signal through the line receiver 174 and thence to the serial-in parallel-out shift register 180. This "TDATA" signal is conducted through the address decoder chip 182 and jumper line 190 to the parallel-in serial-out shift registers 214, 216, to cause the shift registers to latch data from their respective receiver 54 conditioning circuits.

Next, the serial controller chip 134 pulses 96 times to send an "RDATA" signal through the connector 170 and lines 206, 208. The "RDATA" signal includes one or more bits that correspond to the two poles that were selected by the read pole select signal. Thus, the "RDATA" signal determines whether the parallel-in series-out shift registers associated with a particular communication control board A0–B3 will be read for data. Accordingly, when the B0 pole 56 is selected to be a "read" pole, the "RDATA" signal causes the parallel-in serial-out shift registers 214, 216 to sequentially transmit data back through the connector 170 to the "B" pole bank of shift registers 138 in the serial controller board 128.

It is to be understood that the shift registers 214, 216, and the shift registers for the entire series of receiver/emitter control boards in the B0 pole 56 which are serially connected to the shift registers 214, 216 through the connectors 211, 210, serially pass their total of 96 bits of data back through the circuitry described above. The skilled artisan will recognize that the use of parallel-in serial-out shift registers thus permits the use of only two receive signal leads between each communication control board A0–B3 and the serial controller board 128, instead of 96 leads that would otherwise be required if all 96 (or 76, in the case of A poles 58, 62, 66, 70) receivers 54 in a pole reported their data simultaneously.

After the data from the communication control board B0 has been transferred to the serial controller board 128, the C30 board 126 reads the data in the B pole registers 138 of the serial controller board 128 and stores this data for use as further described below. In a like manner, the A pole registers 138 are filled with receive data from the particular communication control board A0–A3 that corresponds to the selected A pole.

Figure 8:
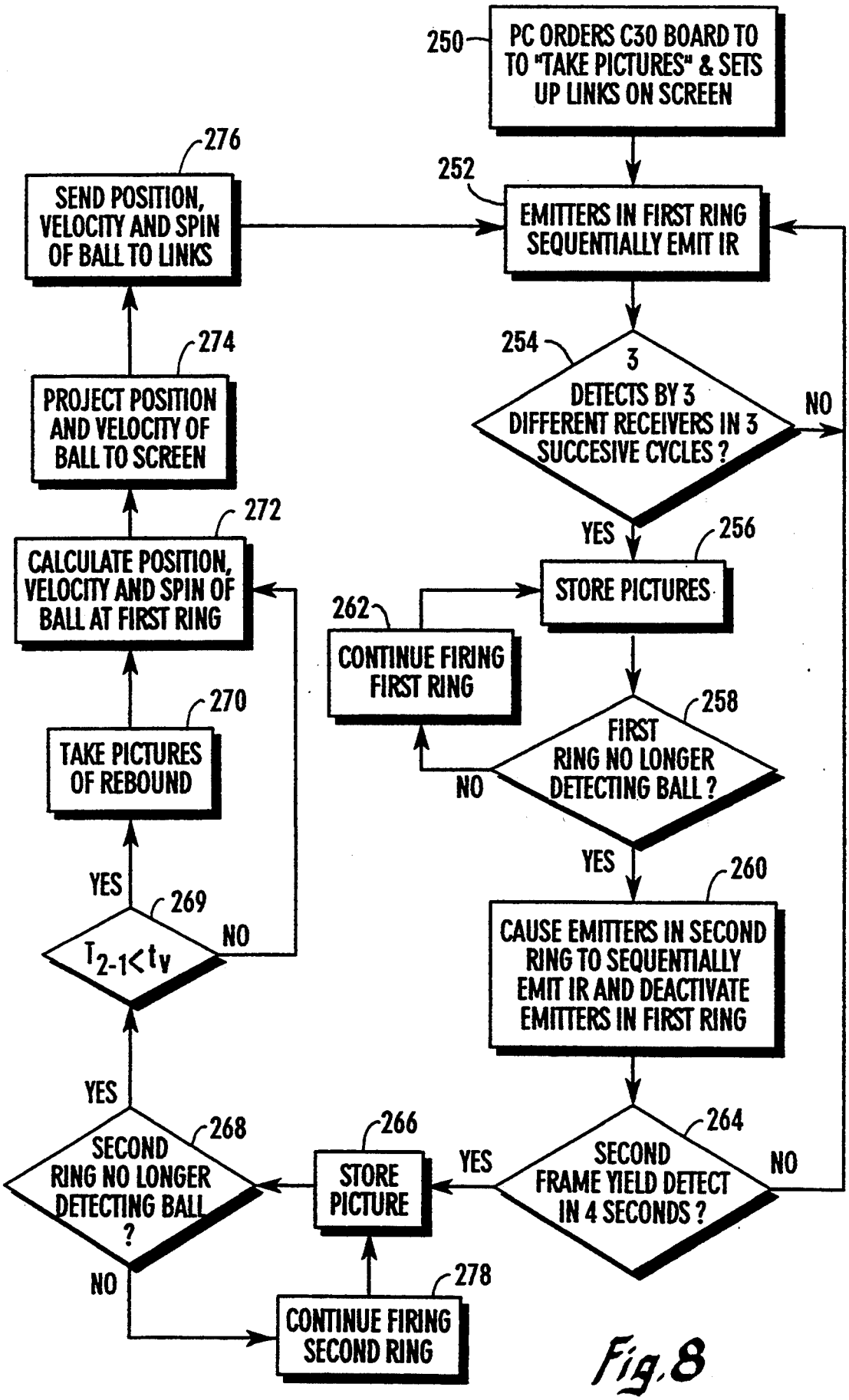
FIG. 8 is a block diagram showing the electrical control sequence of the present invention.

FIG. 8 illustrates the overall logic of the C30 board 126 of the present invention in determining the position, velocity and spin of the golf ball 24 (FIG. 1) after the golf ball 24 has been struck by the golfer 22. As shown at block 250 in FIG. 8, the personal computer 74 initially orders the C30 board 126 to begin the process of taking pictures. As intended by the present invention, an infrared picture "frame" is taken each time an emitter 72 emits a burst of infrared radiation.

A picture frame consists of detection signals from the infrared receivers 54 in the designated receive poles 56–70 which indicate whether each receiver 54 has detected the burst of infrared radiation from the active emitter 72. A complete picture consists of a set of frames corresponding to a burst of IR from each emitter 72 in the array 50, 52. Thus, because each array 50, 52 includes ten emitters 72, one complete picture will include ten frames.

As the golf ball 24 passes through the plane defined by the first array 50 and the plane defined by the second array 52, the shadow of the golf ball 24 will be detected in more than a single frame and by more than a single receiver 54. Indeed, with the time between IR transmissions of successively transmitting emitters 72 being as low as 20 microseconds, depending on the speed of the ball 24, twenty or more pictures that indicate passage of a golf ball 24 through the plane established by one of the arrays 50, 52 can be taken.

As shown at block 250 in FIG. 8, when the personal computer 74 commands the C30 board 126 to begin taking pictures, the personal computer 74 also initializes an appropriate video display program, e.g., the "Links" program made by and commercially available from Access Software of Colorado, and causes a display of an athletic field, e.g., a golf course, to be projected onto the screen 26.

Block 252 next indicates that upon receiving the initialize order from the personal computer, the C30 board 126 causes the emitters 72 in the first array to sequentially emit infrared radiation with about 20 microseconds between emissions. Thus, the first emitter 72 in the first array 50 will emit a burst of infrared radiation. Twenty microseconds later, the second emitter 72 in the first array 50 will emit a burst of infrared radiation, and so on.

As indicated at decision block 254 in FIG. 8, upon detection of a shadow from any one receiver 54, the C30 board 26 temporarily stores that detection and determines whether three different receivers 54 have detected a shadow in three successive cycles of IR radiations after the first detection. This is to ensure against the processing of false detections. If a detection was false as determined in decision block 254, the C30 board 126 returns to block 252. Otherwise, the C30 board 126 proceeds to block 256 wherein the pictures indicating the detections are stored.

If the receivers 54 of the first array are no longer detecting the ball 24, as indicated at decision block 258, the C30 board 126 proceeds to block 260. Otherwise, the C30 board 126 proceeds to block 262 wherein the emitters 72 of the first array 50 continue firing.

As indicated at block 260, in the event that the C30 board 126 determines that the receivers 54 of the first array 50 are no longer detecting the ball 24, the C30 board 126 causes the emitters 72 in the second array 52 to begin sequentially emitting infrared radiation and the C30 board 126 deactivates the emitters 72 in the first array 50. Then, the C30 board 126 proceeds to a decision block 264 wherein the C30 board 126 determines whether the receivers 54 in the second array 52 yielded at least one detect indication within 4 seconds of the last detection in the first array 50. If not, a false detect is indicated and the C30 board 126 returns to block 252. Otherwise, the C30 board 126 proceeds to block 266 wherein the pictures of the second array 52 are stored.

From block 266, the C30 board 126 proceeds to decision block 268, wherein the C30 board 126 determines whether the receivers 54 in the second array 52 are no longer detecting the ball 24. If the result of this test is false, the C30 board 126 moves to block 278 and continues firing the emitters of the second array 52. The C30 board 126 then returns to block 266 and proceeds as described above.

If the result of the test in block 268 is true, the C30 board 126 proceeds to decision block 269 and determines whether the time ($T_{2-1}$) between when the ball passed through the first array 50 and the time the ball passed through the second array 52 is less than a selected threshold time value ($t_v$) which, for example, may be one third of a second. If the outcome is true, then it is assumed the ball was driven as opposed to being putted, and the C30 board 126 moves to block 270 and begins to take pictures of the rebound of the ball 24 from the screen 26. From block 270, or from block 269 if the time ($T_{2-1}$) was greater than the selected time ($t_v$), therefore indicating the ball was putted (and that spin need not be calculated), the C30 board 126 moves to block 272 when the position, velocity and spin of the ball are determined.

It will be appreciated that in order to accurately predict the flight of a golf ball, both ballistic and aerodynamic phenomena must be taken into account. After the golf ball leaves the golf club, ballistic and aerodynamic forces are the only influences on the ball during flight. The amount of "lift" or "dive" of the golf ball can be predicted by measuring the rotational speed component or "spin" of the golf ball around an axis parallel to the floor and perpendicular to the walls. The amount of "hook" or "slice" of the golf ball can be predicted by measuring the spin of the golf ball around an axis parallel to the screen and perpendicular to the floor.

The term velocity is used in the engineering sense. Velocity is a vector quantity with components of both speed and direction. The golf ball departs the golf club with two types of velocity, rotational and translational. Translational velocity is composed of speed and direction (3 dimensional). Rotational velocity is composed of ball rotational speed and rotational axis orientation (3 dimensional).

Translational velocity can be obtained by noting the position and time of passage of the golf ball through the two infra-red detection arrays 50 and 52. Rotational velocity or "spin" can be obtained by noting the position and time of passage of the golf ball through the infra-red detection array 52 closest to the screen as the ball moves toward the screen and again as it bounces off the screen and passes back through array 52, moving away from the screen.

Stated differently, after a driven or pitched golf ball 24 passes through the plane defined by the second array 52, the ball 24 will hit the screen 26 and then bounce back through the plane defined by the second array 52 on a rebound. The angle of the rebound is indicative of the spin of the ball 24, and the spin of the ball 24 affects the computed trajectory of the ball 24. Thus, for driven or pitched golf balls, the spin of the ball must be determined. For putted (i.e., rolling) balls, however, the spin of the ball need not necessarily be calculated.

As noted above, in block 270 the C30 board 126 takes IR pictures of the ball 24 in a manner as described above during the rebound of the ball through the plane defined by the second array 52. Then, the C30 board 126 moves to block 272, wherein the C30 board 126 calculates the velocity, spin and position of the ball at the plane defined by the first array 50 through the standard geometric techniques further disclosed below. For putted golf balls, the C30 determines only the velocity and position of the balls.

After calculating the velocity, spin and position of the ball 24 at the first array 50, the C30 board 126 calculates what the velocity, spin and position of the ball 24 was when it struck the screen 26 (block 274) and sends this projected position, velocity and spin to the video program, which in one preferred embodiment is the "Links" program (block 276). From block 276, the C30 board 126 returns to block 252.

When the video program receives the data from the C30 board 126, the video program then causes the projector 78 to project a video display of the ball 24 on the screen 26 as the ball 24 would have traveled down the projected fairway but for screen 26 blocking the ball 24.

Figure 9:
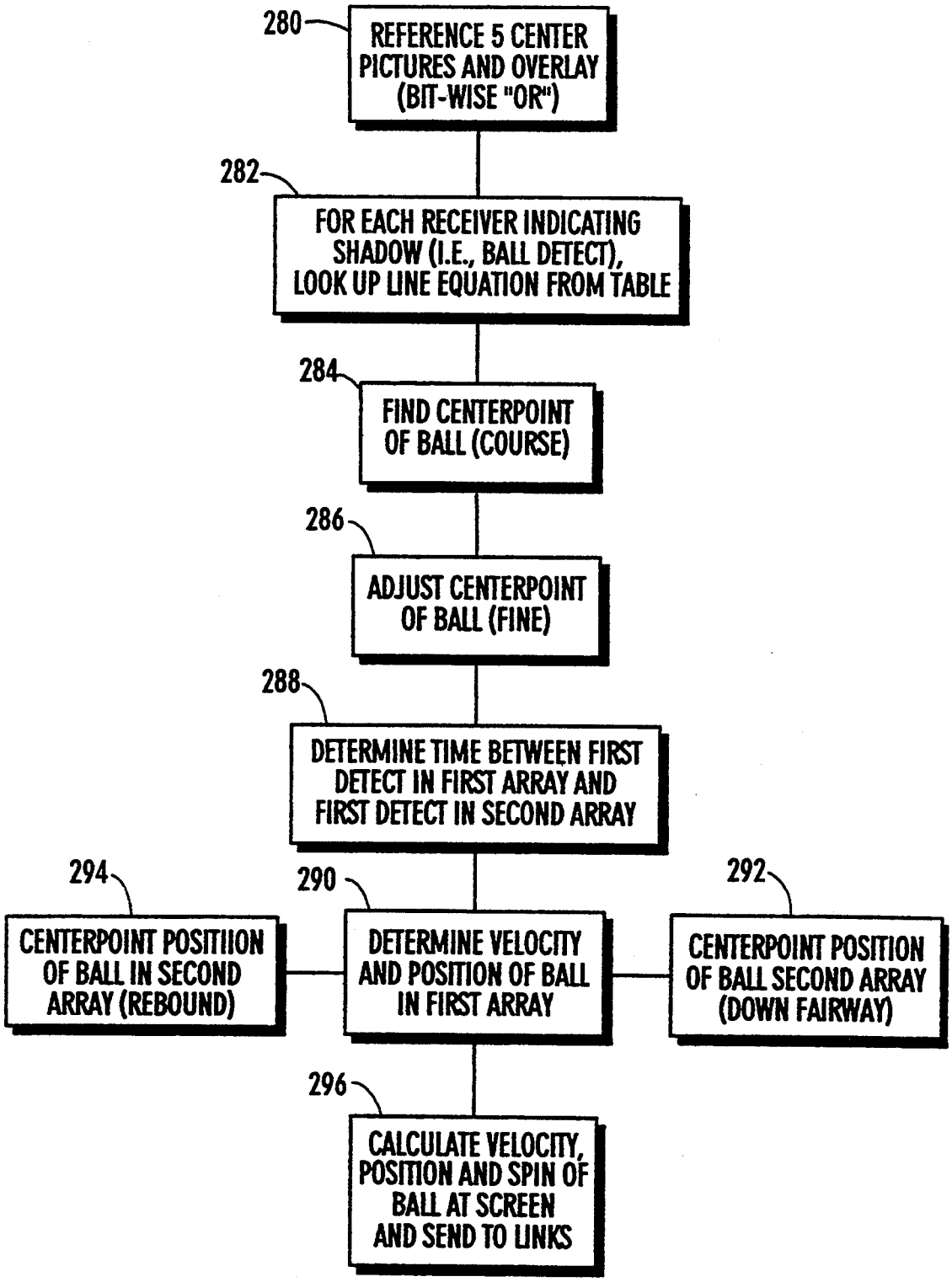
FIG. 9 is a block diagram showing the logic followed by the computer of the present invention in determining the position, velocity and spin of an object such as a golf ball.
Figure 10:
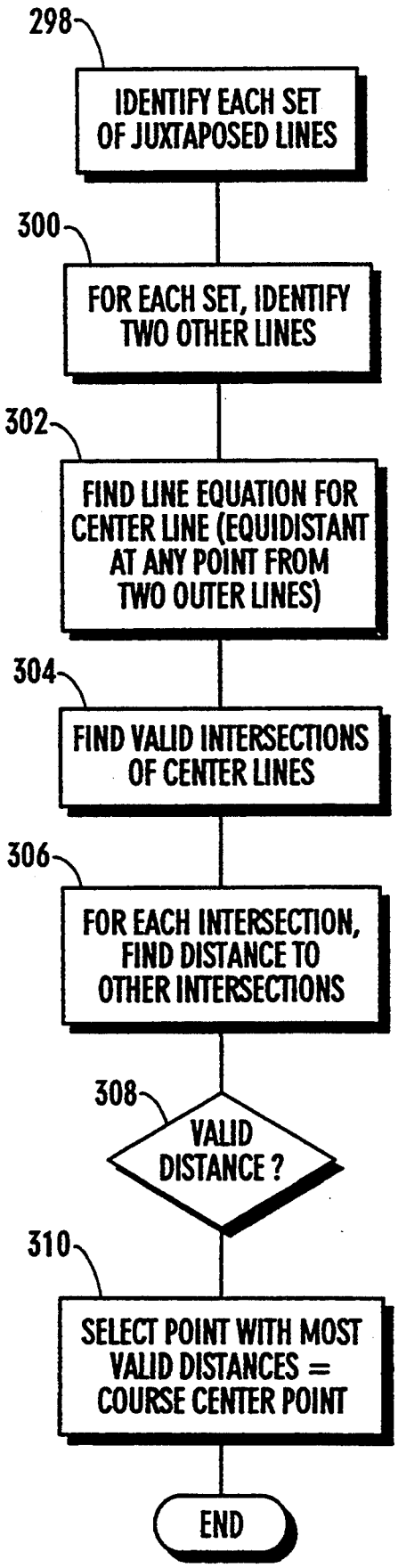
FIG. 10 is a block diagram showing the coarse method by which the computer determines the ball centerpoint when the ball passed through one of the planes of the present invention.
Figure 11:
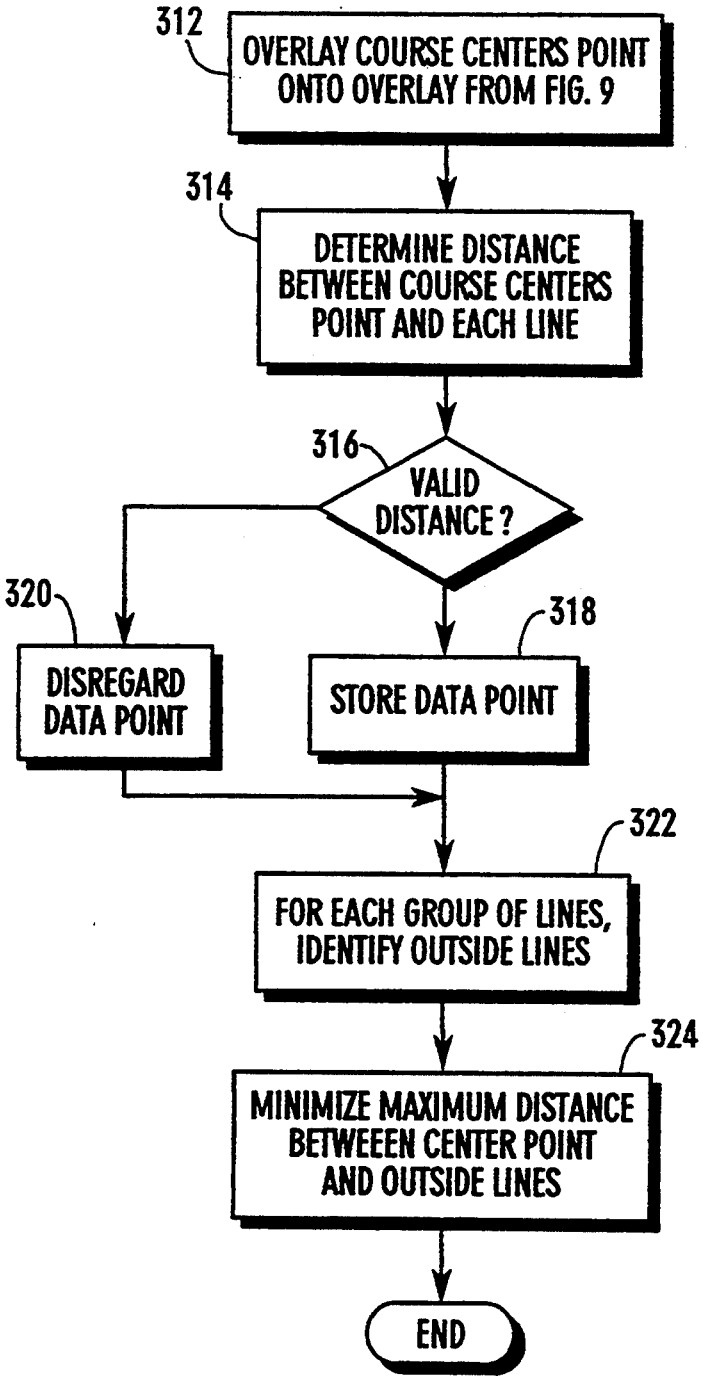
FIG. 11 is a block diagram showing the fine method by which the computer determines the ball centerpoint when the ball passed through one of the planes of the present invention.

In describing the operation of the C30 board 126 at block 272 in FIG. 8, wherein the C30 board 126 calculates the velocity, spin and position of the ball 24 as it passes through the plane defined by the first array 50, reference is made to FIGS. 9–11. As indicated at block 280 in FIG. 9, the C30 board 126 first determines, for each set of pictures from each of the arrays 50, 52, i.e., the five center pictures for each golf ball 24 passage event through the plane defined by the respective array 50, 52. By five center pictures, the present invention intends that in a series of pictures detecting the passage of the ball through the plane defined by an array 50, 52, the five temporally middle pictures are selected.

These five center pictures are overlaid on each other using a bit-wise "or" command. As indicated at block 282, for each receiver 54 that indicates the detection of a shadow, i.e., the detection of the ball 24, the C30 board 126 looks up the appropriate line equation from a pre-stored table. More specifically, an imaginary line extends between each emitter 72 and each receiver 54 in the same array as the emitter 72. The C30 board 126 records the time that each emitter 72 fires and the time that each receiver 54 reports whether it did or did not receive an infrared transmission. Thus, if a particular receiver 54 reports that it did not receive an infrared transmission from an emitter 72 when one was expected, the C30 board 126 knows which emitter-to-receiver line was being blocked by the ball 24, retrieves the equation of this line from the predetermined table, and stores the equation of this line in memory.

From block 282, the C30 board 126 proceeds to block 284 wherein the C30 board 126 determines the center point position, in x-y coordinates, of the ball 24 as it passed through each of the planes defined by the arrays 50, 52. The determination at block 284 is a coarse determination. This coarse determination is explained further below in reference to FIG. 10.

From block 284, the C30 board 126 proceeds to block 286, wherein the C30 board 126 refines the center point x-y position of the ball 24 as it passed through the planes defined by the arrays 50, 52. This fine determination is explained further below in reference to FIG. 11.

From block 286, the C30 board 126 proceeds to block 288, wherein the C30 board 126 determines the elapsed time between the first detection of the ball 24 by a receiver 54 in the first array 50 and the first detection of the ball 24 by a receiver 54 in the second array 52. Then, the C30 board 126 proceeds to block 290 where the C30 board 126 determines the velocity, position and spin of the ball 24 as it passed through the plane defined by the first array 50.

To determine the velocity of the ball 24, the C30 board 126 must proceed as disclosed above to find the center point position of the ball 24 as it passed through the plane defined by the second array 52 as the ball passed down the simulator 10 fairway. Further, to determine the spin of a non-putted golf ball, the C30 board must also determine the center point position of the ball 24 as it passed back through the plane defined by the second array 52 after the ball 24 has rebounded from the screen 26.

More specifically, at block 290, the C30 board 126 determines the position of the ball 24 in X-Y coordinates as the ball passed through the plane defined by the first array 50. Using the process described above, the C30 board 126 also determines the X-Y position of the ball 24 as it passed through the plane defined by the second array 52, both going down the fairway (block 292) and then after rebounding from the screen 26 (block 294). Using the first two X-Y set of coordinates, i.e., the X-Y coordinates of the center of the ball as it passed through the plane defined by the first array 50 and the ball 24 it passed, travelling down the fairway, through the plane defined by the second array 52, the C30 board 126 determines the velocity of the ball 24. To determine the velocity of the ball 24 at the plane defined by the first array 50 the following relationships are used:

$$V_x=(X_2-X_1)/T,$$

where:

T is the elapsed time between passage of the ball through the two arrays 50, 52;

$X_1$ is the x-coordinate of the centerpoint of the ball as it passed the first array 50;

$X_2$ is the centerpoint of the ball as it passed the second array 52; and

Vx is the x-component of the velocity of the ball.

For purposes of the present invention, the X direction is the horizontal direction when looking directly at the screen 26 shown in FIG. 1, i.e., the direction from left to right across the screen 26. The Y direction is the up and down direction when looking at the screen 26 in FIG. 1. The Z direction is the dimension which extends between the two arrays 50, 52.

The following equation is used to determine the y component of the velocity of the ball 24 at the plane defined by the first array 50:

$$V_{y1}=[(Y_2-Y_1)-(\tfrac{1}{2}AT^2)]/T$$

where:

A is the acceleration of gravity (384 inches per second, per second);

T is the elapsed time between ball passage past the first and second arrays 50, 52; and $Y_1$ and $Y_2$ are the y coordinates of the centerpoint of the ball 24 as it passed through the planes defined by the first and second arrays 50, 52, respectively.

Also, to determine the Z-component of velocity, $$V_z=Z_0/T$$

where $Z_0$ is the distance between the two arrays 50 52.

Thus, the C30 board 126 determines the velocity and position of the ball 24 as it passed through the first array. Using the equations of motion, the C30 board 126 can then project, at block 296, the position and velocity that the ball 24 had when the ball 24 struck the screen 24.

Because of the small distance between the arrays 50, 52 and the screen 26, environmental effects such as wind resistance are not taken into consideration in projecting the ball position onto the screen. However, the influence of gravity is considered as it affects the velocity in the Y axis. Accordingly, the values determined above for $V_x$ and $V_z$ are used as their respective velocity values at the screen 26. The velocity of the ball at the screen, in the Y axis is determined by the following relationships:

$$V_{ys}=V_{y1}+(A\times T_s)$$

where:

A is the acceleration of gravity (384 inches per second); and $T_s$ is the elapsed time between ball passage past the first array 50 to ball impact at the screen 26, which time value can be found from the following relationship:

$$T_s=D_s/V_z$$

where:

$D_s$ is the distance between the first array 50 and the screen 26.

The position of the ball may be projected to the screen surface by the following relationships:

$$P_{xs}=P_{x1}+(V_x\times T_s)$$

where:

$P_{xs}$ is position of along with the X axis; and $P_{x1}$ is position of the ball as it passed through the first array 50 along the X axis.

$$P_{ys}=P_{y1}+(V_{y1}\times T_2)+(\tfrac{1}{2}AT_s^2)$$

where:

$P_{ys}$ is position of the ball on the screen 26 along the Y axis; and $P_{y1}$ is position of the ball as it passed through the first array 50 along the Y axis.

To determine the spin of the ball, the computer compares the recorded positions of the center points of the ball as it passed through the second plane (i.e., the plane defined by the second array 52) going down the fairway and then as the ball returns through the second plane after the ball rebounds from the screen 26.

Calculating the rotational velocity of the golf ball from the inbound and outbound time and position sets of information involves the assumption of conservation of rotational energy of the golf ball. As the ball strikes the screen at an angle (3 dimensional), rotational ball energy will be converted into translational energy. This new translational energy will manifest itself as translational velocity which will be added (vector addition) to the translational velocity of the golf ball as it rebounds from the screen. This change in transitional velocity of the golf ball as it rebounds from the screen will be observed as a change in the expected rebound angle from the screen in a rebound situation where there is no rotational to translational energy conversion. Some energy will be lost to the screen during the time that the golf ball is in contact with the screen, and this lost energy must be subtracted from the total rebound ball energy.

In determining the spin of the ball, the presently preferred embodiment assumes for calculation purposes that there are no aerodynamic effects before the ball hits the screen 26. It also assumes that the exact mechanics of the ball hitting the screen are not important, so long as the initial spin of the ball is absorbed in the screen 26 and the ball is rolling on and parallel to the screen by the time contact with the screen 26 is lost. The following relationships are used to determine the spin of the ball:

$$W_x=\frac{(1+\mu)V_{xo}-\partial V_{xI}}{\mu r}$$

$$W_y=\frac{(1+\mu)Y_{YI}}{\mu r}$$

where:

$W_x$ is the ball spin in the X axis as the ball is going into the screen, in radians per second.

$W_y$ is the ball spin in the Y axis as the ball is going into the screen, in radians per second.

$V_{xI}$ is velocity along the X axis of the ball going into the screen.

$V_{yI}$ is velocity along the Y axis of the ball going into the screen.

$V_{xo}$ is velocity along the X axis of the ball after rebounding off the screen.

$V_{yo}$ is velocity along the Y axis of the ball after rebounding off the screen.

r is the radius of the ball.

$\partial$ is the damping coefficient for ball travel along the screen (0 to 1).

$\mu$ is the conversion factor for changing spin energy to translational energy (0 to 1).

The values of $\mu$ and $\partial$ are determined empirically. In one presently preferred embodiment, r is 0.84 inches; $\partial$ is 0.74 inches; and $\mu$ is 0.23 inches.

In the preferred embodiment, the values of $\partial$ and $\mu$ are developed by storing actual data from numerous trials, and selecting representative values. One method for developing this data, so that a rebound/spin relationship can be identified is to install a club face orientation and velocity sensor, (not shown), next to the tee area 20 to sense the speed and club face angle of the club used by the golfer 22 to strike the ball 24. Such an apparatus is marketed under the trade name Sport Tech, and is made by Sport Tech, Inc., of Idaho.

The golf ball 24 is hit a large number of times against the screen 26, and the position of the ball 24 as it passed through the second plane both going down the fairway and returning from the rebound can be recorded. This information can be used to determine values to be used for d and $\mu$. Alternatively, with w and $\mu$ provide, the golf club dynamics data sensed by the sensor may be converted into a ball spin value by the sensor and stored in a table along with the corresponding golf ball 24 down-fairway and rebound centerpoints. The C30 board 126 can then refer to the look-up table and identify the spin of a golf ball for subsequent strokes, based upon the centerpoint positions of the golf ball as it passed through the second plane both going down the fairway and returning from the rebound.

Figure 12:
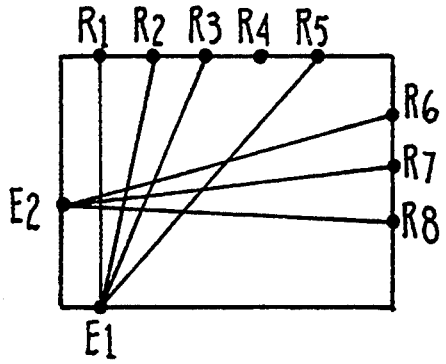
FIG. 12 is a schematic diagram showing several emitter-to-receiver bearing lines.

Now referring to FIG. 10, the details of the coarse determination of the center point of the ball 24 as it passed through a particular plane of receivers 24 are shown. Specifically, as indicated at block 298, the C30 board 126 identifies each set of juxtaposed lines. More specifically, the C30 board 126 identifies each set of detection lines from the overlay of the five center frames wherein successive receivers 54 indicated a detection. Thus, referring briefly to FIG. 12, receivers R1, R2 and R3 each indicated that the golf ball 24 was interposed between them and the emitter E1. The receiver R4 did not indicate a reception of a shadow and receiver R5 did indicate that it detected a shadow.

Accordingly, the set of juxtaposed lines for the emitter E1 that is identified by the C30 board 126 at block 298 includes the lines which extend from the emitter E1 to the receivers R1, R2 and R3. Next, at block 300, the C30 board 126 identifies the two outer lines for each set. In the example shown in FIG. 12, the two outer lines for the set discussed above are the lines which extend between emitter E1 and receivers R1 and R3.

Then, at block 302, the C30 board 126 determines the line equation for the center line between the two outer lines, i.e., the line consisting of points that are equidistant from the lines R1–E1 and R3–E1. The center line for the set discussed above is the line R2–E1. The C30 board 126 then proceeds to block 304, wherein the C30 board 126 finds valid intersections of center lines. More particularly, FIG. 11 shows that there is a second group of juxtaposed lines, the lines E2–R6, E2–R7, E2–R8, the center line of which is the E2–R7 line.

The C30 board 126 next proceeds to block 304, wherein the C30 board determines, for each intersection of center lines, whether the intersection is valid. To be a valid intersection, the angle between the intersecting centerlines under test must be greater than or equal to a predetermined angle. This is because the intersection between lines that are nearly parallel cannot be reliably positioned.

To determine whether the angle between the intersecting lines exceeds the predetermined value, the C30 board 126 uses standard trigonometry, i.e., the C30 board 126 computes the arctangent of the slope of each line (which equals the angle of each line relative to the cartesian coordinate system defined by the array 50, 52) and it takes the difference between the angles of each line. If the difference between the angles exceeds the predetermined value, the intersection is considered to be valid. In the preferred embodiment, the predetermined value is 20°.

At block 304, the C30 board 126 not only determines valid intersections, but also determines the X-Y coordinates of each valid intersection. the C30 board 126 develops a table of the X-Y coordinates of the intersection.

To determine the X-Y coordinates of each intersection, the C30 board 126 uses standard geometric techniques. Specifically, the C30 board 126 uses the following equations:

$$Y_1 = M_1 X_1 + B_1;$$

$$Y_2 = M_2 X_2 + B_2;$$

$$Y_1 = Y_2;$$

$$X_1 = X_2;$$

where $X_1$, $Y_1$ is the cartesian coordinate of a point on the first line at the intersection, $H_2$, $Y_2$ is the cartesian coordinate of a point on the second line at the intersection, $M_1$, $M_2$ are the slopes of the respective lines, and $B_1$, $B_2$ are Y intercepts of the respective lines.

The C30 board 126 sets $Y_1 = Y_2$ and $X_1 = X_2$, and is then able to algebraically solve for the X,Y intersection point of the two lines.

Next, the C30 board 126 proceeds to block 306 wherein for each intersection, the C30 board 126 determines, for each valid intersection, the distance from the intersection to all other valid intersections, and the C30 board 126 creates a table of these distances. To make this determination, the C30 board 126 uses the following equation:

$$\text{distance} = \sqrt{(X_2 - X_1)^2 + (Y_2 - Y_1)^2}$$

From block 306, the C30 board 126 proceeds to decision block 308, wherein for each distance calculated at block 306 the C30 board 126 determines whether the distance is valid. In other words, the C30 board 126 determines whether each distance tested is within a predetermined value. In the preferred embodiment, the predetermined value is 1.4 inches.

The C30 board 126 then moves to block 310, wherein the C30 board 126 determines which intersection point has the most valid distances between all the other intersection points. The point with the most valid distance comparisons is set equal to the coarse center point of the ball 24.

Now referring to FIG. 11, the details of the refined center point adjust of block 286 in FIG. 9 can be seen. At block 312 of FIG. 11, the coarse center point of the ball 24 as determined from the subroutine of FIG. 10 is overlaid onto the bit-wise "or" overlay that was developed at block 280 in FIG. 9. Then, at block 314 the distance between the coarse center point and each line in the overlay is determined using well-known algebraic techniques. Each distance so determined is stored.

Next, at decision block 316, each distance is compared to a predetermined distance. If any distance is greater than the predetermined distance, that distance is disregarded for further processing. In the preferred embodiment, the predetermined distance is 5 inches.

If the tested distance is less than the predetermined distance, the tested distance is found to be valid and the C30 board 126 proceeds to block 318, wherein the data point is stored. Otherwise, the C30 board 126 proceeds to block 320, wherein the C30 board 126 disregards the invalid data point. Next, at block 322, the C30 board 126 identifies the outside lines for each group of juxtaposed line. Thus, again referring to FIG. 11 as an example, the lines E1–R1 and E1–R3 and the lines E2–R6, E2–R8 would be considered.

The C30 board 126 then proceeds to block 324, wherein the C30 board 126 minimizes the maximum distance between the center point and each of the outside lines. To do this, the C30 board 126 moves the center point in incremental amounts toward the line furthest from the center point. After each incremental move, the C30 board 126 recalculates the distance between each of the outside lines and the center point and continues to move the center point the incremental amount toward whichever line is determined to be furthest away from the center point. In a preferred embodiment, the C30 board 26 undertakes one hundred such iterations and the incremental distance is five-thousandths of an inch 0.05").

At the end of the 100th iteration, the position of the center point is taken to be the position of the ball as it passed through that particular plane. In other words, the X-Y coordinates of the center point at the end of the 100 iterations is taken to be the X-Y coordinates which are used to indicate the position of the ball for calculation purposes in the overall logic diagram of FIG. 8.

The software described herein, some of which is listed in the attached Microfiche Appendix, was translated from source code to machine readable object using the "C" language compilers and utilities. Nonetheless, one skilled in the technology will recognize that the steps in the accompanying flow diagrams can be implemented using a number of different compilers and/or programming languages.

It should also be observed that the foregoing flow diagrams are only meant to represent the functional equivalents of their named source code counterparts, and so, the diagrams may include material that does not completely parallel the named location of the function.

In summary, the invention described herein comprises a significant improvement over the prior art by providing a sports simulator that is very versatile in its adaption to simulation of various sports involving moving objects. The invention also overcomes other long existent problems in the industry by providing a sports simulator that: (1) functions without the requirement that the object being moved toward the screen start from a specific, pre-determined location; (2) provides accurate simulation of object movements into an illustrated environment by use of only two arrays of sensors; (3) accurately determines velocity and trajectory, including spin, of objects such as balls projected into it, for simulation purposes; and (4) is less complex and thus less costly to produce than the prior art systems, due in large part to the two sensor infrared array in the simulator.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within the scope.

We claim:

1. A sports simulator, comprising:

a launch area from which an object can be accelerated;

a screen distanced from the launch area in the direction of travel of the object;

first and second emitters for transmitting electromagnetic radiation, the emitters being distanced from the launch area in the direction of travel of the object;

a first array of receivers distanced from the launch area in the direction of travel of the object and interposed between the launch area and the screen, at least some of the receivers in the first array being positioned to receive radiation from the first emitter and generating respective signals in response thereto, the first array of receivers being arranged in a first plane;

a second array of receivers arranged in a second plane and interposed between the screen and the first array of receivers in the direction of travel of the object, at least some of the receivers in the second array being positioned to receive radiation from the second emitter and generating respective signals in response thereto; and a computer electrically connected to both arrays of receivers for producing an estimate of the projected position of the object based on the translational velocity of the object which is determined from first and second signals from the receivers indicative of first and second positions of the object detected by the first and second arrays of receivers respectively, and upon the rotational velocity of the object which is determined from the second signal indicative of the second position, from a third signal indicative of the position of the object relative to the second array of receivers after the object has rebounded from the screen, and from at least one rotational velocity value selected from a plurality of rotational velocity values stored in the computer.

2. The simulator of claim 1, wherein the computer produces an estimate of the projected position of the object in two dimensional coordinates.

3. The simulator of claim 1, wherein the computer produces an estimate of the projected position of the object in three dimensional coordinates.

4. The simulator of claim 1, further comprising a housing having a first end and a second end, the launch area being located near the first end of the housing.

5. The simulator of claim 4, wherein the screen is attached to the housing and covers the second end of the housing for stopping the object from passing through the second end of the housing, the screen also establishing a substrate on which a video display can be projected.

6. The simulator of claim 5, wherein the screen is made of shock absorbing material.

7. The simulator of claim 1, wherein the housing has an interior surface, and the first plane intersects the interior surface, the intersection of the first plane and interior surface establishing the edge of a first polygon, wherein the emitters in the first array are mounted on the interior surface of the housing along the edge of the first polygon.

8. The simulator of claim 2, wherein the housing has an interior surface, and the second plane intersects the interior surface, the intersection of the second plane and interior surface establishing the edge of a second polygon, wherein the emitters in the second array are mounted on the interior surface of the housing along the edge of the second polygon.

9. The simulator of claim 8, wherein the first emitter is mounted on the interior surface of the housing and establishes a portion of the edge of the first polygon, and the second emitter is mounted on the interior surface of the housing and establishes a portion of the edge of the second polygon.

10. The simulator of claim 9, further comprising a first plurality of emitters mounted on the housing and positioned on the edge of the first polygon, a line of sight being established between at least one of the first emitters and at least one of the receivers in the first array, and a second plurality of emitters mounted on the housing and positioned on the edge of the second polygon, a line of sight being established between the second emitter and at least one of the receivers in the second array.

11. The simulator of claim 10, wherein the emitters in the first plurality are electrically connected to the computer, and the computer causes the emitters to sequentially emit infrared radiation pulses.

12. The simulator of claim 11, wherein the object passing through the edge of the first polygon interrupts the line of sight between at least one of the emitters and at least one of the receivers in the first array to cause the receiver to generate a signal representative of the passage of the object.

13. The simulator of claim 12, wherein the emitters in the second plurality are electrically connected to the computer, and the computer causes the emitters to sequentially emit infrared radiation pulses.

14. The simulator of claim 13, wherein the object passing through the edge of the second polygon interrupts the line of sight between at least one of the emitters and at least one of the receivers in the second array to cause the receiver to generate a signal representative of the passage of the object.

15. The simulator of claim 14, further comprising a video projector electrically connected to the computer, wherein the computer generates a signal representative of the trajectory of the object, and causes a video image of the object as it would have appeared, had it not encountered the screen, to be displayed on the screen.

16. The simulator of claim 1, wherein the plurality of rotational velocity data values stored in the computer is comprised of a plurality of damping coefficient values representative of the amount of rotational energy of the object that is damped when the object comes in contact with the screen.

17. The simulator of claim 16, wherein the plurality of stored rotational velocity values further comprises a plurality of conversion factor values representative of the amount of rotational energy that is changed into translational energy when the object comes in contact with the screen.

18. The simulator of claim 17, wherein the plurality of damping coefficient values and the plurality of conversion factors are empirical values selected to model the projected path of the object and wherein the computer selects one of the plurality of damping coefficient values and one of the plurality of conversion factors based at least in part on the second signal indicative of the second position of the object as the object travels toward the screen.

19. The simulator of claim 1, wherein the plurality of rotational velocity data values is comprised of a plurality of empirically determined object spin values and the computer selects one of the plurality of empirically determined object spin values at least in part based on the second and third signals indicating the position of the object relative to the second array of receivers.

20. A golf simulator, comprising:

a computer, a projector electrically connected to the computer;

a housing having a tee area from which a golf ball can be accelerated;

a screen attached to the housing and distanced from the tee area in the direction of motion of the golf ball for preventing the golf ball from passing beyond the screen, wherein the computer generates a first control signal representative of translational velocity and a second control signal representative of rotational velocity of the golf bal, and wherein the computer causes the projector to project a video image of the golf ball as it would have appeared, had it not encountered the screen, on the screen based on the first and second control signals; and means for generating a plurality of sensing signals in response to motion of the golf ball though the housing, the generating means comprising first and second arrays of motion sensors arranged in respective first and second planes within the housing, the planes being disposed between the tee area and the screen wherein the first and second array of motion sensors produce first and second sensing signals indicative of the position of the golf ball in the first and second planes respectively as the golf ball travels toward the screen and a third sensing signal indicative of the position of the golf ball in the second plane after the golf ball rebounds from the screen, wherein the computer uses the second and third sensing signals along with at least one rotational velocity data value selected from a plurality of rotational velocity data values stored in the computer to produce the second control signal representative of the rotational velocity of the golf ball.

21. The simulator of claim 20, further comprising:

a first plurality of infrared radiation emitters mounted on the housing and establishing the first plane, the first plane intersecting the housing to establish an edge of a first polygon, the emitters being positioned on the edge of the first polygon; and a second plurality of infrared radiation emitters mounted on the housing and establishing the second plane, the second plane intersecting the housing to establish an edge of a second polygon.

22. The simulator of claim 21, further comprising:

a first array of receivers positioned on the edge of the first polygon, at least some of the receivers in the first array being positioned to receive the infrared radiation from at least one emitter in the first plurality of emitters and generating respective signals in response thereto;

a second array of receivers positioned on the edge of the second polygon, at least some of the receivers in the second array being positioned to receive the infrared radiation from at least one emitter in the second plurality of emitters and generating respective signals in response thereto.

23. The simulator of claim 22, wherein emitters in the first plurality of emitters are electrically connected to the computer, and the computer causes the emitters to sequentially emit infrared radiation pulses.

24. The simulator of claim 23, a golf ball passing through the edge of the first polygon interrupts the line of sight between at least one of the emitters and at least one of the receivers in the first array to cause the receiver to generate a signal representative of the passage of the ball.

25. The simulator of claim 24, wherein the emitters in the second plurality are electrically connected to the computer, and the computer causes the emitters to sequentially emit infrared radiation pulses.

26. The simulator of claim 25, wherein a golf ball passing through the edge of the second polygon interrupts the line of sight between at least one of the emitters and at least one of the receivers in the second array to cause the receiver to generate a signal representative of the passage of the ball.

27. The simulator of claim 20, wherein the plurality of rotational velocity values stored in the computer is comprised of a plurality of damping coefficient values representative of the amount of rotational energy of the golf ball that is damped when the golf ball comes in contact with the screen.

28. The simulator of claim 27, wherein the plurality of stored rotational velocity values further comprises a plurality of conversion factor values representative of the amount of rotational energy that is changed into translational energy when the golf ball comes in contact with the screen.

29. The simulator of claim 28, wherein the plurality of damping coefficient values and the plurality of conversion factors are empirical values selected to model the projected path of the golf ball, and the computer selects one of the plurality of damping coefficient values and one of the plurality of conversion factors based at least in part on the second signal indicative of the second position of the golf ball as the golf ball travels toward the screen.

30. The simulator of claim 20, wherein the plurality of rotational velocity values is comprised of a plurality of empirically determined object spin values and wherein the computer selects one of the plurality of empirically determined golf ball spin values at least in part based on the second and third signals indicating the position of the object relative the second array of receivers.

31. A method for projecting a video image of a golf ball on a screen illustrating how the golf ball would have moved, had the golf ball not encountered the screen, comprising the steps of:

accelerating the golf ball from a tee area toward the screen;

sensing the passage of the golf ball through a first plane located between the tee area and the screen and generating a first signal in response thereto;

sensing the passage of the golf ball through a second plane located between the first plane and the screen and generating a second signal in response thereto;

computing, based on the first and second signals, the position and translational velocity of the golf ball as the golf ball struck the screen;

sensing the passage of the golf ball through the second plane after the golf ball struck the screen and generating a third signal in response thereto;

selecting at least one rotational velocity value form a plurality of rotational velocity values stored in a memory;

computing the rotational velocity of the golf ball as the golf ball struck the screen using the second and third signals along with selected rotational velocity data values; and projecting a video image of the golf ball on the screen in accordance with the computed translational velocity and rotational velocity of the golf ball.

32. The method of claim 31, wherein the step of selecting at least one rotational velocity value from a plurality stored rotational velocity values includes the steps of:

selecting one of a plurality of empirically determined damping coefficient values representative of the amount of rotational energy of the golf ball that is damped when the golf ball comes in contact with the screen; and selecting one of a plurality of empirically determined conversion factors representative of the amount of energy that is changed into translational energy when the golf ball comes in contact with the screen.

33. The method according to claim 32, wherein the computer selects one of the plurality of damping coefficient and one of the plurality of conversion factors based in part on the first and second and third signals indicative of the position of the ball as the ball passes through the second plane.

34. The method according to claim 33, wherein the step of selecting at least one rotational velocity value form a plurality of rotational velocity values stored in memory comprises the step of selecting a golf ball spin value form a plurality of empirically determined golf ball spin values based at least in part on the second and third signals indicative of the position of the golf ball in the second plane as the golf ball travels towards the screen and rebounds from the screen.

35. A sports simulator, comprising:

a launching area for accelerating an object;

a screen for displaying a projecting path of the accelerated object, which screen also prevents the object from travelling beyond said screen;

a first sensor which detects the position of the object in a first plane interposed between the launching area and the screen, and which produces a first signal indicative thereof;

a second sensor for detecting the location of the object in a second plane interposed between the launching area and the screen, said second sensor producing a second signal indicative of said location of the object in said second plane as the object travels from the launching area to the screen and said second sensor producing a third signal indicative of the location of the object in said second plane after the object has rebounded off of the screen; and a computer responsive to the first, second and third signals for determining translational velocity of the object using the first and second signals and for determining the rotational velocity of the object using the second and third signals along with at least one rotational velocity value selected from a plurality of rotational velocity values stored in the computer, wherein the computer uses the translational and rotational velocity to produce signals used to display the projected path of the object on the screen.

36. The simulator of claim 35, wherein the object is a golf ball and the simulator displays the projected path of the accelerated golf ball on the screen after the golf ball has been accelerated from the launching area.

37. The simulator of claim 35, wherein the plurality of rotational velocity values stored in the computer is comprised of a plurality of damping coefficient values representative of the amount of rotational energy of the object that is damped when the object comes in contact with the screen.

38. The simulator of claim 37, wherein the plurality of stored rotational velocity data values further comprises a plurality of conversion factors representative of the amount of rotational energy that is changed into translational energy when the object comes in contact with the screen.

39. The simulator of claim 35, wherein the plurality of damping coefficient values and the plurality of conversion factors are empirical values selected to model the projected path of the accelerated object and wherein the computer selects one of the plurality of damping coefficient values and one of the plurality of conversion factors based at least in part on the second signal indicative of the second position of the object in the second plane.

40. The simulator of claim 35, wherein the plurality of rotational velocity data values is comprised of a plurality of object spin values and the computer selects one of the plurality of empirically determined object spin values at least in part based on the second and third signals indicating the position of the object relative the second array of receivers.

41. The simulator of claim 35, wherein the plurality of rotational velocity values is empirically developed by repeatedly accelerating objects toward the screen, observing the characteristics of the objects as they hit the screen, and selecting representative values of the observed characteristics to constitute the plurality of rotational velocity values.

42. The simulator of claim 35, wherein the first sensor is comprised of a first emitter and a first array of receivers positioned relative to the first emitter so that at least some of the receivers receive radiation from the first emitter and generate respective signals in response thereto, and the second sensor is comprised of a second emitter and a second array of receivers positioned relative to the second emitter so that at least some of the receivers receive radiation from the second emitter and generate respective signals in response thereto.

43. The simulator of claim 42, wherein the first and second array of receivers are positioned so that the object prevents the radiation from the first and second emitters from reaching selected receivers in the first and second array of receivers when the object passes through a first and second plane respectively defined by the first and second array of receivers.

44. The simulator of claim 43, wherein the computer, in response to receiving the first and second signals from the first and second array of receivers, determines the position of the object in the first and second planes along the X axis and the Y axis as the object travels substantially in the direction of the Z axis toward the screen.

45. The simulator of claim 35, further comprising a housing wherein the launching area is positioned at substantially one end of the housing and the screen is positioned at substantially the other end of the housing with the first and second sensors positioned in the housing interposed between the launching area and the screen.

46. The simulator of claim 35, wherein the first sensor include a first plurality of emitters and receivers which are oriented along the X axis of the first plane and a second plurality of emitters and receivers which are oriented along the Y axis of the first plane, whereby the first and second plurality of emitters and receivers respectively detect the X position and the Y position of the object in the first plane.

47. The simulator of claim 46, wherein the second sensor include a third plurality of emitters and receivers which are oriented along the X axis of the second plane and a fourth plurality of emitters and receivers which are oriented along the Y axis of the second plane, whereby the third and fourth plurality of emitters and receivers respectively detect the X position and the Y position of the object in the second plane.

48. The simulator of claim 35, wherein the sensors are configured to monitor only the first and second planes.

49. A method of projecting an image of an accelerated object on a screen illustrating the projecting path of the object, had the object not encountered the screen, comprising the steps of:

accelerating the object from a launch area toward the screen;

sensing the passage of the object through a first plane located between the launch area and the screen and generating a first signal in response thereto;

sensing the passage of the object through a second plane located between the first plane and the screen and generating a second signal in response thereto;

determining, based on the first and second signals, the position and translational velocity of the object as the object strikes the screen;

sensing the passage of the object through the second plane after the golf ball has struck the screen and generating a third signal in response thereto;

providing a plurality of rotational velocity data values selected to model the effects of rotation on the object;

selecting at least one rotational velocity value from the plurality of rotational velocity values based at least in part on the second signal;

determining the rotational velocity of the object at the time the object strikes the screen, based upon the second and third signals along with selected rotational velocity values; and projecting a video image of the object on the screen in accordance with the computer determined translational velocity and rotational velocity of the object.

50. The method of claim 49, wherein the plurality of rotational velocity values is empirically developed by repeatedly accelerating objects toward the screen, observing the characteristics of the objects as they hit the screen, and selecting representative values of the observed characteristics to constitute the plurality of rotational velocity values.

51. The method of claim 49, wherein the plurality of rotational velocity values comprises a plurality of object spin values.

52. The method of claim 49, wherein the plurality of rotational velocity values comprises a plurality of damping coefficient values representative of the amount of rotational energy of the object that is damped when the object comes in contact with the screen.

53. The method of claim 52, wherein the plurality of rotational velocity values further comprises a plurality of conversion factors representative of the amount of rotational energy that is changed into translational energy when the object comes in contact with the screen.

* * * * *